US009755388B2

(12) United States Patent
Zien et al.

(10) Patent No.: US 9,755,388 B2
(45) Date of Patent: Sep. 5, 2017

(54) RECONFIGURABLE PLUG STRIP

(71) Applicant: Q HOLDINGS LLC, New York, NY (US)

(72) Inventors: Jacob Daniel Zien, New York, NY (US); Jordan Diatlo, New York, NY (US); Kate Sarah Vallon, Suffern, NY (US); Steven Richard Remy, New York, NY (US); Richard Ganas, New York, NY (US); David Sutton, New York, NY (US); Nicholas Oxley, New York, NY (US)

(73) Assignee: Q Holdings LLC, New York, NY (US)

( * ) Notice: Subject to any disclaimer, the term of this patent is extended or adjusted under 35 U.S.C. 154(b) by 639 days.

(21) Appl. No.: 13/962,627

(22) Filed: Aug. 8, 2013

(65) Prior Publication Data

US 2014/0102870 A1 Apr. 17, 2014

Related U.S. Application Data

(63) Continuation of application No. 13/568,833, filed on Aug. 7, 2012, now Pat. No. 8,529,289, which is a (Continued)

(51) Int. Cl.
*H01R 13/66* (2006.01)
*H01R 35/00* (2006.01)

(Continued)

(52) U.S. Cl.
CPC ..... *H01R 35/00* (2013.01); *H01R 13/514* (2013.01); *H01R 25/003* (2013.01); *H01R 29/00* (2013.01);

(Continued)

(58) Field of Classification Search
CPC ..... H01R 35/00; H01R 33/955; H01R 35/02; H01R 13/641; H01R 13/70; H01R 13/66;

(Continued)

(56) References Cited

U.S. PATENT DOCUMENTS 2,134,355 A 7/1934 Caldwell
3,437,976 A 4/1969 Nelson (Continued)

FOREIGN PATENT DOCUMENTS

CN 101562304 10/2009
CN 202737189 2/2013

(Continued)

OTHER PUBLICATIONS

International Search Report for International Application No. PCT/US2011/051522, mailed Feb. 28, 2012.

(Continued)

*Primary Examiner* — Jean F Duverne
(74) *Attorney, Agent, or Firm* — Hard IP LLC

(57) ABSTRACT

A power strip for conducting electrical power between an electrical power outlet having at least a live receptacle and a neutral receptacle, and at least two electrical device power plugs, each plug having at least a live prong and a neutral prong. The power strip includes a first housing segment having a first receptacle configured to receive at least an electrically conductive portion of a first device plug and a second housing segment having a second receptacle configured to receive at least an electrically conductive portion of a second device plug. The second housing is coupled to the first housing for pivotal movement relative to said first housing.

21 Claims, 31 Drawing Sheets

Related U.S. Application Data continuation of application No. 13/095,167, filed on Apr. 27, 2011, now Pat. No. 8,262,399.

(51) Int. Cl.

| | |
|---|---|
| ***H01R 25/00*** | (2006.01) |
| ***H01R 29/00*** | (2006.01) |
| ***H01R 35/04*** | (2006.01) |
| ***H01R 13/514*** | (2006.01) |
| ***H01R 33/955*** | (2006.01) |
| *H01R 13/641* | (2006.01) |
| *H01R 13/70* | (2006.01) |
| *H01R 35/02* | (2006.01) |

(52) U.S. Cl.

CPC ..... *H01R 33/955* (2013.01); *H01R 35/02* (2013.01); *H01R 35/04* (2013.01); *H01R 13/641* (2013.01); *H01R 13/66* (2013.01); *H01R 13/6658* (2013.01); *H01R 13/70* (2013.01); *H01R 35/025* (2013.01)

(58) Field of Classification Search

CPC .. H01R 13/6658; H01R 13/514; H01R 29/00; H01R 25/003; H01R 35/04; H01R 35/025

USPC ..... 439/527

See application file for complete search history.

(56) References Cited

U.S. PATENT DOCUMENTS

| | | | | |
|---|---|---|---|---|
| 3,771,106 | A | 11/1973 | Matsumoto et al. | |
| 3,951,487 | A | 4/1976 | Waldbrook | |
| 4,583,798 | A | 4/1986 | Blazowich | |
| 5,292,257 | A | 3/1994 | Milan | |
| 5,484,299 | A | 1/1996 | Schlessinger | |
| D381,315 | S | 7/1997 | Harold | |
| D401,220 | S | 11/1998 | Dwight et al. | |
| 5,902,140 | A | 5/1999 | Cheung et al. | |
| 5,967,815 | A | 10/1999 | Schlessinger et al. | |
| D416,860 | S | 11/1999 | Seiwert et al. | |
| 6,068,490 | A | 5/2000 | Salzberg | |
| 6,196,851 | B1 | 3/2001 | Gerard et al. | |
| 6,229,107 | B1 | 5/2001 | Flint et al. | |
| D445,403 | S | 7/2001 | Veino et al. | |
| 6,793,499 | B1 | 9/2004 | Chen | |
| 6,862,403 | B2 | 3/2005 | Pedrotti et al. | |
| D507,237 | S | 7/2005 | Gregory | |
| D514,067 | S | 1/2006 | Lee | |
| 6,991,495 | B1 | 1/2006 | Aromin | |
| 7,125,256 | B2 | 10/2006 | Gerard | |
| 7,238,028 | B2 | 7/2007 | Gerard | |
| 7,247,028 | B2 | 7/2007 | Schriefer | |
| 7,264,514 | B2 | 9/2007 | Hsu et al. | |
| 7,278,878 | B2 | 10/2007 | Draggie et al. | |
| D556,689 | S | 12/2007 | Lee et al. | |
| 7,435,091 | B1 | 10/2008 | Cruz | |
| 7,488,204 | B2 | 2/2009 | Hsu | |
| 7,500,854 | B2 | 3/2009 | Gottstein | |
| D597,948 | S | 8/2009 | Bizzell | |
| 7,625,241 | B2 | 12/2009 | Axland et al. | |
| 7,753,682 | B2 | 7/2010 | Gerard | |
| 7,771,239 | B1 | 8/2010 | Hsiao | |
| 7,811,136 | B1 | 10/2010 | Hsieh et al. | |
| 7,824,185 | B2 * | 11/2010 | Chien | F21S 4/28 439/11 |
| 7,874,856 | B1 * | 1/2011 | Schriefer | H01R 13/514 439/214 |
| D633,045 | S | 2/2011 | Cullen et al. | |
| D640,199 | S | 6/2011 | Wilson | |
| 8,011,930 | B2 * | 9/2011 | Lee | H01R 13/6675 439/18 |
| 8,025,527 | B1 | 9/2011 | Draggie et al. | |
| D651,174 | S | 12/2011 | Le Clair | |
| 8,118,616 | B1 * | 2/2012 | Clark | H01R 25/006 439/640 |
| 8,157,574 | B2 | 4/2012 | Hsiao | |
| 8,262,399 | B1 | 9/2012 | Zien et al. | |
| 8,500,484 | B2 * | 8/2013 | Hu | H01R 24/22 439/527 |
| 8,500,492 | B2 * | 8/2013 | Brown | H01R 35/04 439/638 |
| 8,529,289 | B2 | 9/2013 | Zien et al. | |
| 9,028,274 | B2 * | 5/2015 | Zien | H01R 13/514 439/527 |
| 2005/0032396 | A1 | 2/2005 | Huang | |
| 2006/0068608 | A1 | 3/2006 | McFadden | |
| 2006/0234561 | A1 * | 10/2006 | Tanaka | H01R 25/003 439/652 |
| 2007/0178756 | A1 | 8/2007 | Schriefer et al. | |
| 2008/0231121 | A1 | 9/2008 | Yang et al. | |
| 2010/0132970 | A1 * | 6/2010 | Axland | H01R 25/006 174/53 |
| 2012/0028505 | A1 * | 2/2012 | Weber | H01R 25/003 439/638 |
| 2012/0108101 | A1 | 5/2012 | Hu | |
| 2014/0102870 | A1 | 4/2014 | Zien et al. | |
| 2014/0187079 | A1 | 7/2014 | Zien et al. | |

FOREIGN PATENT DOCUMENTS

| | | |
|---|---|---|
| DE | 20313536 | 12/2003 |
| DE | 102005046465 | 4/2007 |
| EP | 0702433 | 3/1996 |
| JP | 2005-056758 | 3/2005 |
| JP | 2000-277222 | 10/2006 |
| RU | 2283521 | 9/2006 |
| RU | 2316090 | 1/2008 |
| SU | 466689 | 4/1975 |
| SU | 838832 | 6/1981 |
| WO | WO2009/0104162 | 8/2009 |
| WO | WO2010/0127606 | 11/2010 |
| WO | WO2012/148440 | 11/2012 |

OTHER PUBLICATIONS

Notice of Allowance for U.S. Appl. No. 13/095,167 mailed Jun. 25, 2012, 7 pages.

International Search Report and Written Opinion for International Application No. PCT/US2014/010541, mailed May 2, 2014, 8 pages.

Office Action for Chinese Patent Application 201320033486.X, dated Oct. 11, 2013, 4 pages.

Office Action for Chinese Patent Application 201320033486.X, dated Jun. 5, 2013, 4 pages.

Office Action for Chinese Patent Application 201220035403.6, dated Jul. 18, 2012, 4 pages.

Office Action for U.S. Appl. No. 13/568,833, mailed Feb. 8, 2013, 6 pages.

Extended European Search Report dated Oct. 10.2016 received in EP Application No. 14735136.6; 9 pages.

European Search Report dated Oct. 27, 2016 received in EP Application No. 14735136.5, 5 pages.

* cited by examiner

554

567

567

567

567

700

RECONFIGURABLE PLUG STRIP

CROSS-REFERENCE TO RELATED APPLICATIONS

This application is a continuation of U.S. patent application Ser. No. 13/568,833, filed Aug. 7, 2012, now U.S. Pat. No. 8,529,289, entitled "Reconfigurable Plug Strip," which is a continuation of U.S. patent application Ser. No. 13/095,167, filed Apr. 27, 2011, now U.S. Pat. No. 8,262,399, entitled "Reconfigurable Plug Strip," the disclosures of each of which are hereby incorporated by reference in their entirety.

FIELD OF THE INVENTION

Some embodiments described herein relate generally to plug strips, specifically to reconfigurable plug strips.

BACKGROUND

Permanent electrical and other outlets typically include a limited number of outlets usable to plug in devices requiring electrical power, or requiring access to a signal path to and/or from a signal source. When more outlets are needed, a plug strip can be coupled to a permanent outlet, which increases the number of outlets available. However, the outlets on such plug strips may be oriented so that devices such as power adapters having large housings in fixed orientation with respect to their electrical plugs can obstruct some of the outlets, reducing the benefit of the plug strip. Furthermore, the length and/or width of the plug strip can limit the locations where the plug strip can be placed.

Thus a need exists for a reconfigurable plug strip.

SUMMARY OF THE INVENTION

In some embodiments, an apparatus can provide an electrical signal path between an electrically conductive portion of a device plug and a signal port. The apparatus can include a first housing segment having a first receptacle configured to receive at least the electrically conductive portion of the device plug and a second housing segment having a second receptacle configured to receive at least the electrically conductive portion of the device plug. The second housing can be coupled to the first housing for movement relative to the first housing segment.

The apparatus can include a signal port coupler configured to selectively conductively engage with the signal port. The apparatus can include a first conductive connector coupled to the first housing segment. The first conductive connector can include a first portion disposed to conductively engage with the electrically conductive portion of the device plug when received in the first receptacle, and a second portion electrically coupled to the signal port coupler, and a third portion. The apparatus can include a second conductive connector coupled to said second housing segment. The second conductive connector can include a first portion disposed to conductively engage with the electrically conductive portion of the device plug when received in the second receptacle, and a second portion in slidable conductive engagement with the third portion of said first conductive connector. Whereby the electrically conductive portion of the device plug when engaged with the first portion of either of the first conductive connector and the second conductive connector is electrically coupled to the signal port coupler for selective conductive coupling to the signal port.

DETAILED DESCRIPTION

As used in this specification, the singular forms "a," "an" and "the" include plural referents unless the context clearly dictates otherwise. Thus, for example, the term "rotation post" is intended to mean a single rotation post or a combination of rotation posts.

Figure 1:
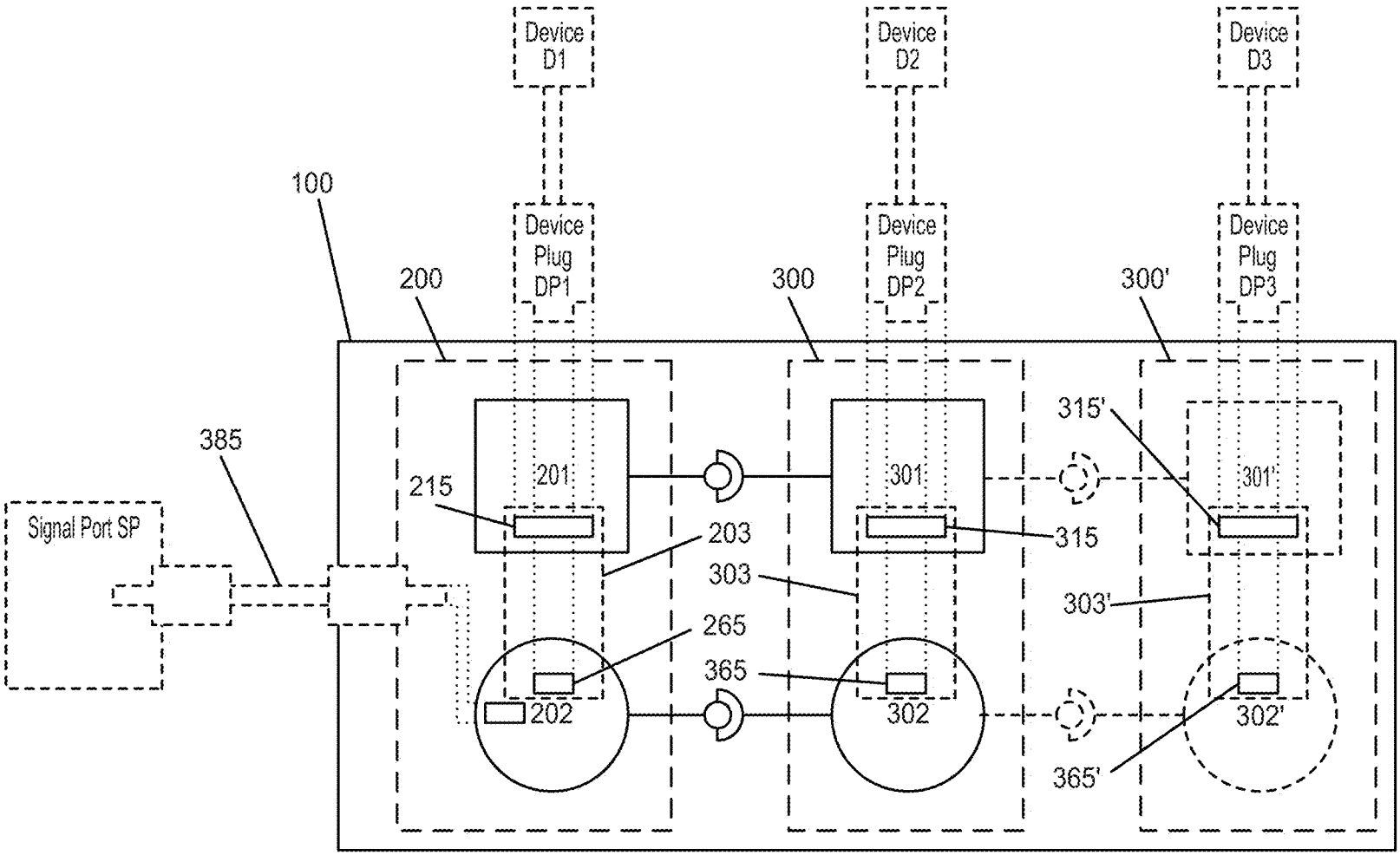
FIG. 1 is a block diagram of a plug strip according to an embodiment.

FIG. 1 depicts a system block diagram of a plug strip 100. Plug strip 100 can be a reconfigurable plug strip, i.e., can be a series of segments movably connected to one or more other segments. Specifically, plug strip 100 includes a base segment 200, and an intermediate segment 300. In some embodiments, plug strip 100 can include any number of intermediate segments. Base segment 200 includes a mechanical portion 201 and an electrical portion 202, and intermediate segment 300 includes a mechanical portion 301 and an electrical portion 302.

Mechanical portion 201 of base segment 200 can be configured to movably connect base segment 200 with intermediate segment 300, to fixedly or selectively physically connect plug strip 100 to a cord 385 (shown in dash lines in FIG. 1), and to guide a device plug DP1 of a device D1 into an outlet assembly 203 of base segment 200. Mechanical portion 201 can be configured to mechanically connect device plug DP1 to base segment 200 via mechanical portion 215 of outlet assembly 203. Cord 385 can be configured to connect plug strip 100 to a signal port SP1. In some embodiments, base segment 200 and intermediate segment 300 can be movable relative to each other about a single axis in a single plane, for example, intermediate segment 300 can be rotatable about a single axis of intermediate segment 300. In other embodiments, base segment 200 and intermediate segment 300, can be movable relative to each other in one or more other planes and/or about or along one or more other axes.

Electrical portion 202 of base segment 200 can be configured to define a signal path between base segment 200 and the signal port SP1 (via cord 385), and to define a signal path between intermediate segment 300 and signal port SP1. Specifically, electrical portion 202 can be configured to define the signal path between an electrical portion 265 of outlet assembly 203 of base segment 200 and/or an electrical portion 365 of an outlet assembly 303 of intermediate segment 300 with the signal port SP1. The signal path can include any signal path and/or combination of signal paths usable to conduct power, data, audio, video, and/or other electrical signals from the signal port SP1 to the base segment 200 and/or the intermediate segment 300. Electrical portion 202 can be configured to maintain the signal path between the signal port SP1 and base segment 200 and/or intermediate segment 300 when base segment 200 and intermediate segment 300 are moved relative to one another. Electrical portion 202 can be configured to fixedly or selectively connect a signal path between plug strip 100 to a cord 385 via a circuit board 285 of base segment 200, and cord 385 can be configured to connect a signal path between plug strip 100 and the signal port SP1.

Mechanical portion 301 of intermediate segment 300 can be configured to movably connect intermediate segment 300 with base segment 200, and/or a second intermediate segment 300' (shown in dash lines in FIG. 1), and/or a third intermediate segment (not shown in FIG. 1). In this manner, an intermediate portion can be movably connected to base segment 200, second intermediate segment 300', base segment 200 and second intermediate segment 300', or second intermediate segment 300' and the third intermediate segment. In some embodiments, intermediate segment 300 can be movable relative to base segment 200, and/or second intermediate segment 300', and/or the third intermediate segment, in a single plane or multiple planes, as discussed above with regard to base segment 200. Mechanical portion 301 can be configured to direct or guide a device plug DP2 of a device D2 into an outlet assembly 303 of intermediate segment 300. Mechanical portion 301 can be configured to mechanically connect device plug DP2 to intermediate segment 300 via mechanical portion 315 of outlet assembly 303.

Electrical portion 302 of intermediate segment 300 can be configured to define a signal path between intermediate segment 300 and signal port SP1, and to define a signal path between other intermediate segments and signal port SP1. Specifically, electrical portion 302 can be configured to define the signal path between an electrical portion 385 of outlet assembly 303 of intermediate segment 300 and/or an electrical portion 365' of an outlet assembly 303' of intermediate segment 300' with signal port SP1. The signal path can include any signal path and/or combination of signal paths usable to conduct power, data, audio, video, and/or other signals to/from signal port SP1 to the intermediate segment 300 and/or the other intermediate segments. Electrical portion 302 can be configured to maintain the signal path between signal port SP1 and intermediate segment 300 and/or the other intermediate segments when base segment 200, intermediate segment 300, and the other intermediate segments are moved relative to one another.

Figure 2A:
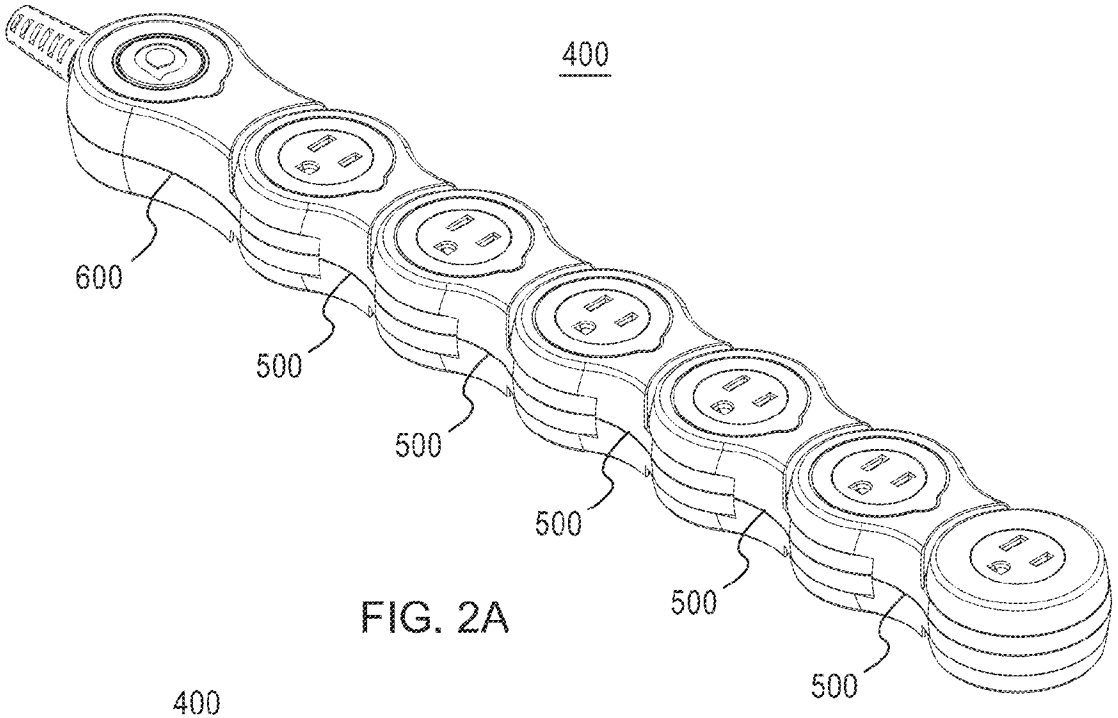
FIG. 2A is a perspective view of a plug strip in a first configuration according to an embodiment.
Figure 2B:
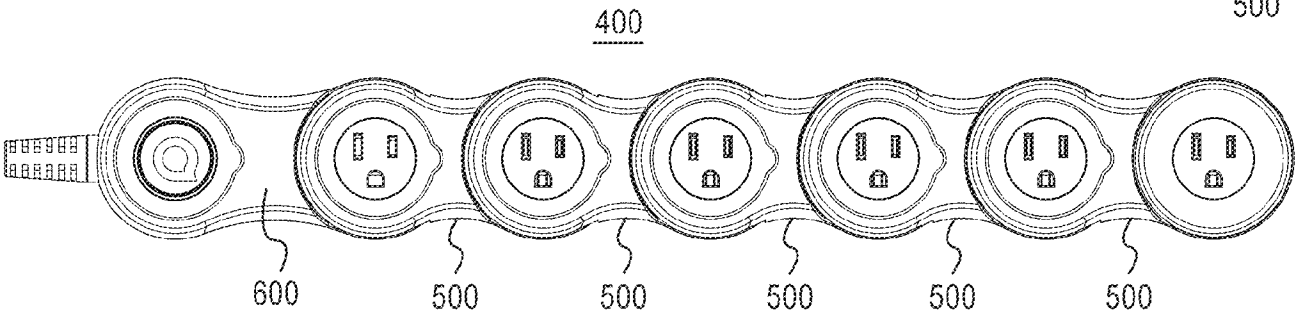
FIG. 2B is a top view of the plug strip shown in FIG. 2A in the first configuration.
Figure 2C:
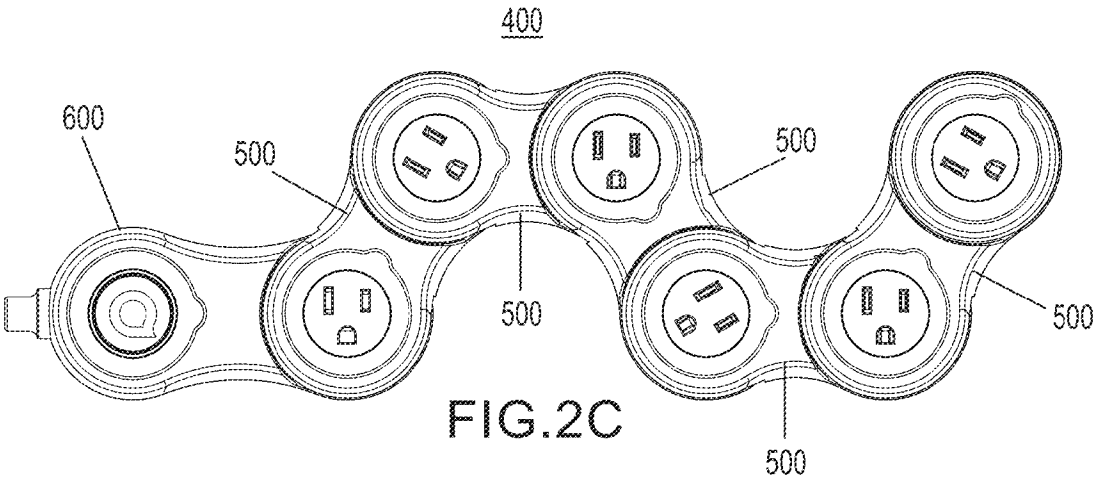
FIG. 2C is a top view of the plug strip shown in FIG. 2A in a second configuration.
Figure 2D:
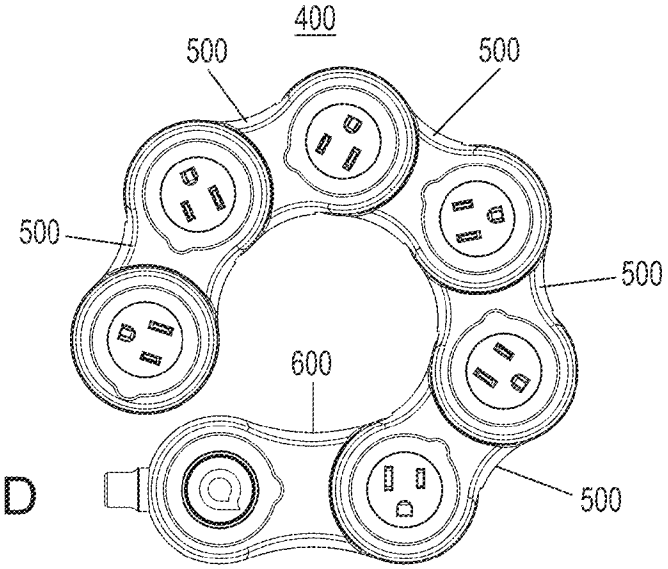
FIG. 2D is a top view of the plug strip shown in FIG. 2A in a third configuration.
Figure 2E:
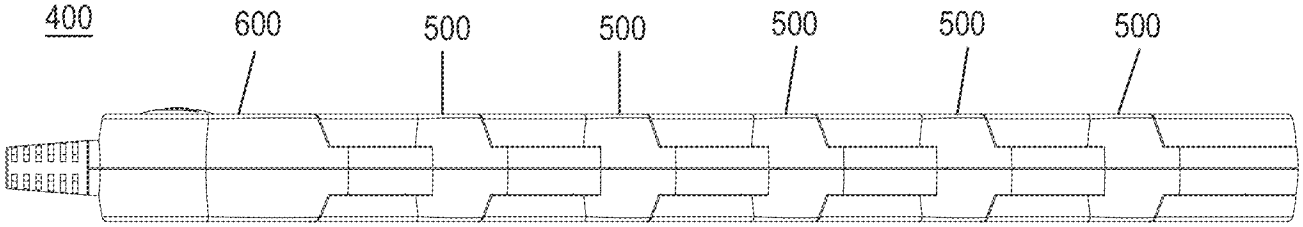
FIG. 2E is a side view of the plug strip shown in FIG. 2A in the first configuration.
Figure 2F:
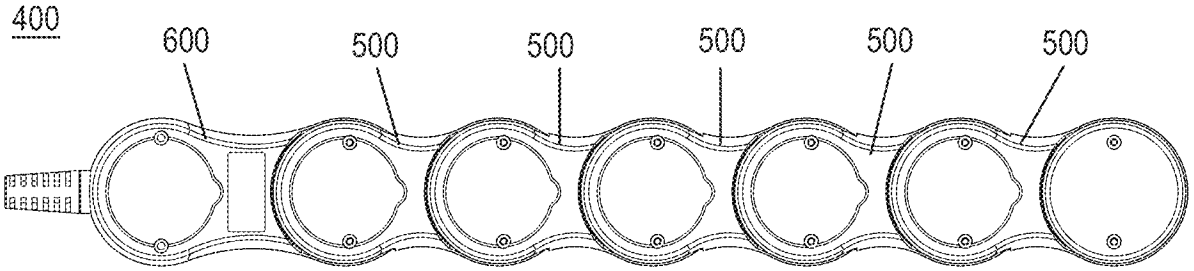
FIG. 2F is a bottom view of the plug strip shown in FIG. 2A in the first configuration.
Figure 2G:
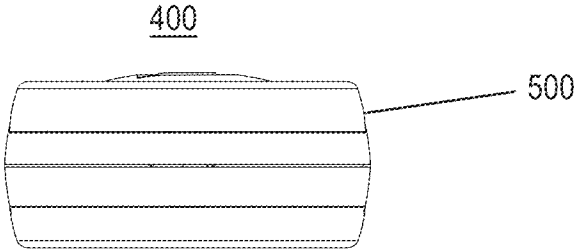
FIG. 2G is a front view of the plug strip shown in FIG. 2A in the first configuration.

An exemplary implementation of a plug strip is described in detail below. This implementation is an electrical power strip, specifically, a 120 volt, 3 prong plug strip. FIGS. 2A-2D depict a plug strip 400. Specifically, FIG. 2A is a perspective view of plug strip 400 in a first configuration (straight), FIG. 2B is a top view of plug strip 400 in the first configuration, FIG. 2C is a top view of plug strip 400 in a second configuration (sinusoid), FIG. 2D is a top view of plug strip 400 in a third configuration (circular), FIG. 2E is a side view of plug strip 400 in the first configuration, FIG. 2F is a bottom view of plug strip 400 in the first configuration, and FIG. 2G is a front view of plug strip 400 in the first configuration. Plug strip 400 includes a base segment 600 and five intermediate segments 500.

Figure 3A:
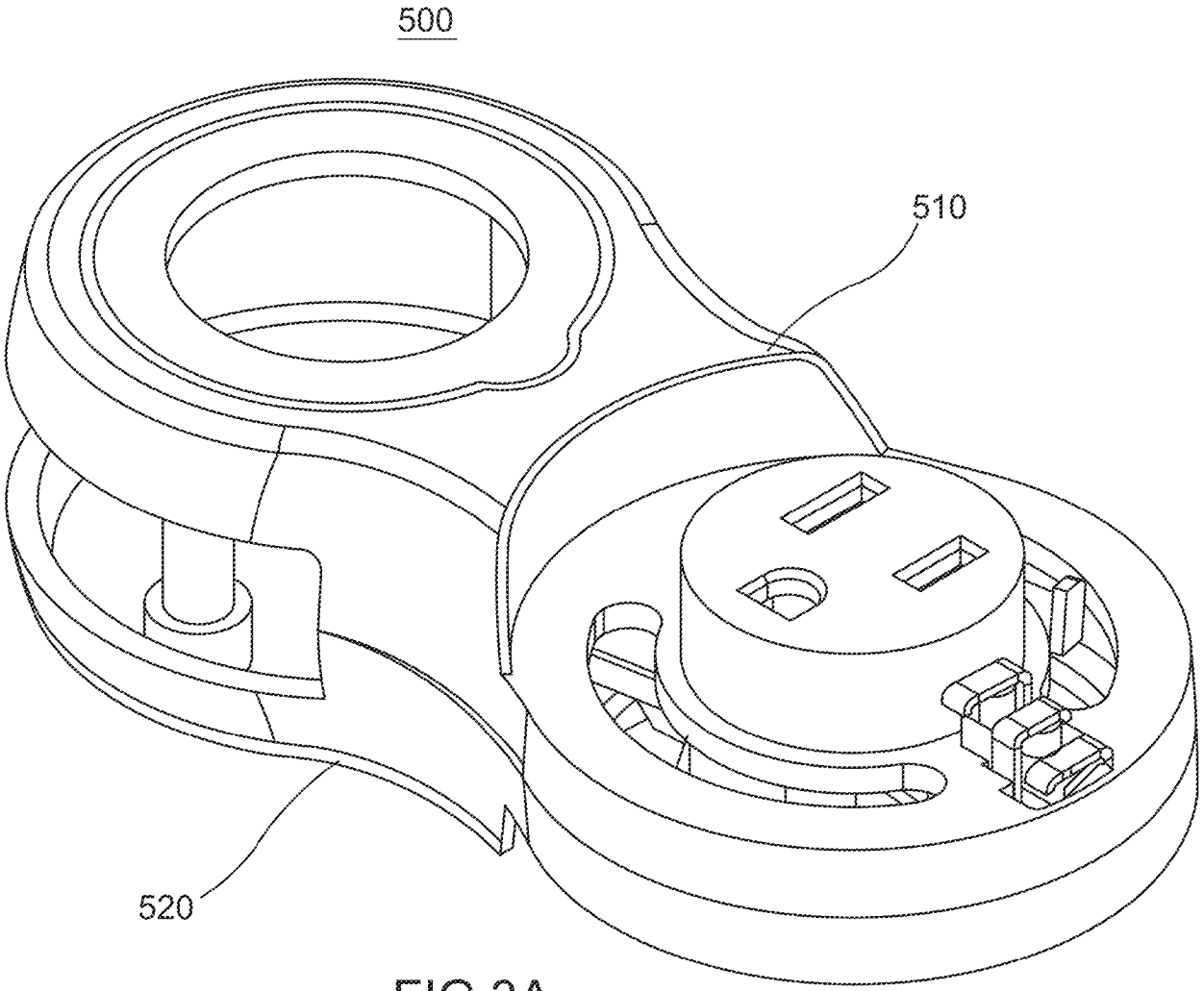
FIG. 3A is a perspective view of an intermediate segment of the plug strip shown in FIG. 2A.
Figure 3B:
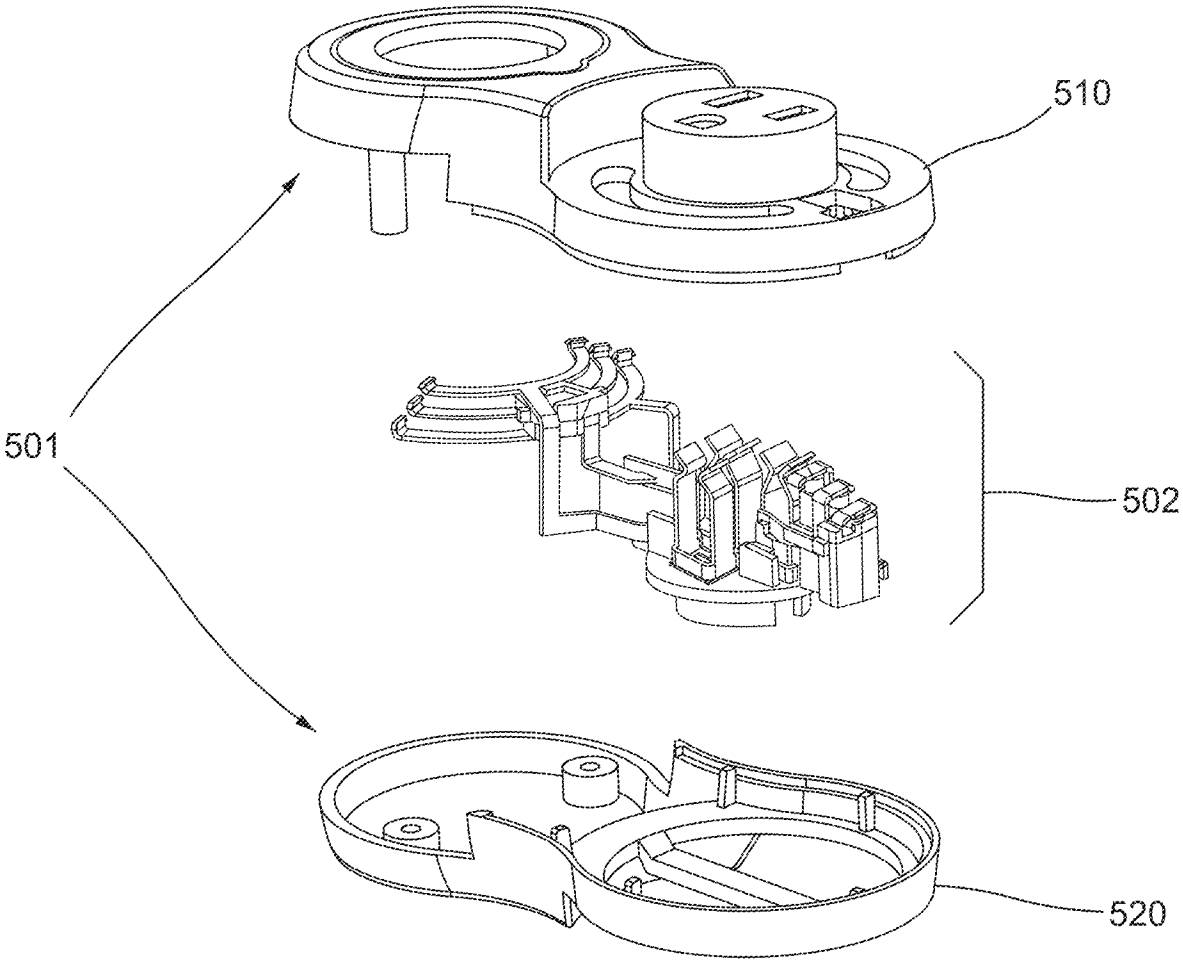
FIG. 3B is a partially exploded view of the intermediate segment shown in FIG. 3A.
Figure 3C:
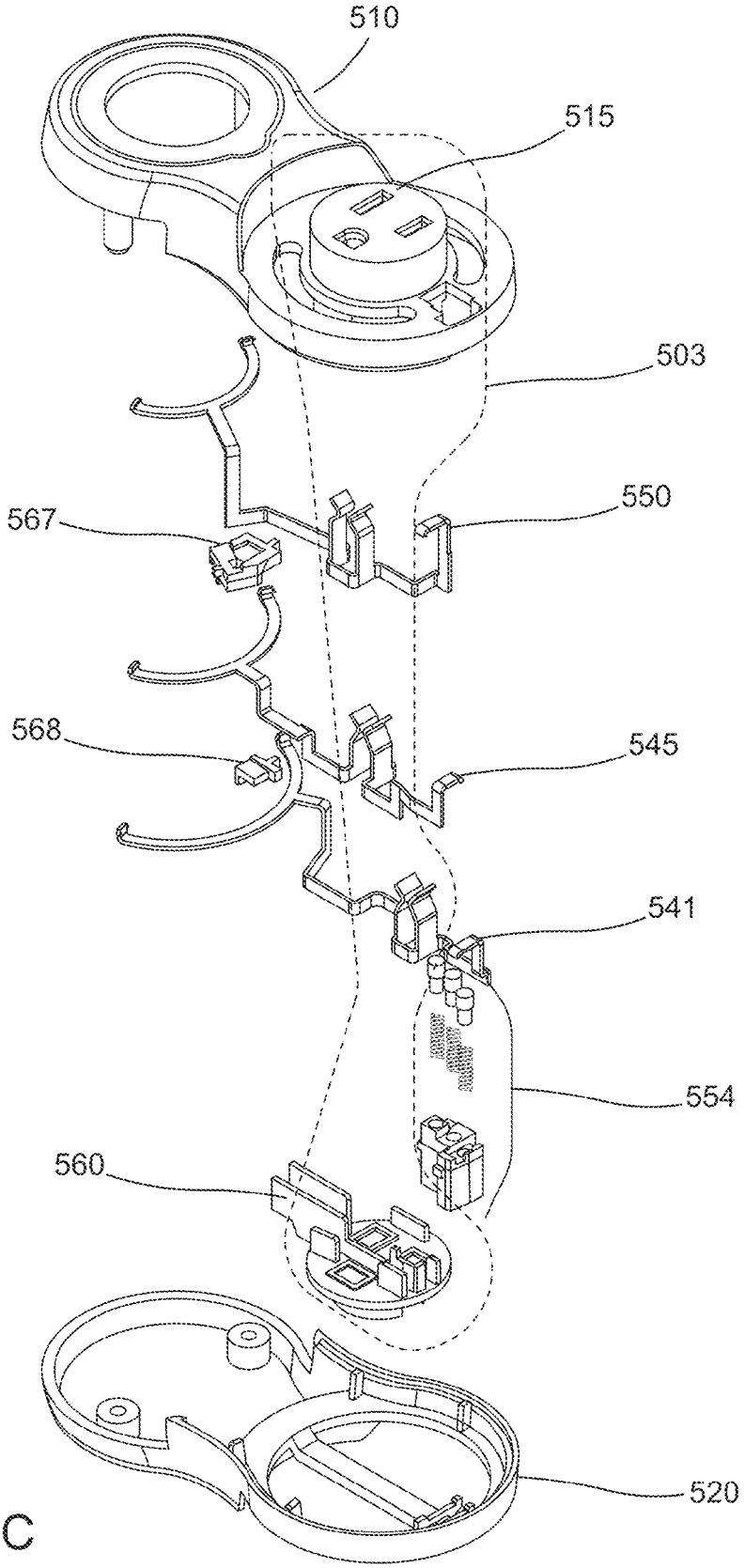
FIG. 3C is a fully exploded view of the intermediate segment shown in FIG. 3A.

FIGS. 3A-3C depict intermediate segment 500 of plug strip 400. Specifically, FIG. 3A is a front perspective view of intermediate segment 500, FIG. 3B is a partially exploded front perspective view, and FIG. 3C is a fully exploded front perspective view of intermediate segment 500. Intermediate segment 500 includes a mechanical portion 501 including a top housing 510 and a bottom housing 520, an electrical portion 502, and a plug portion 503.

Figure 4A:
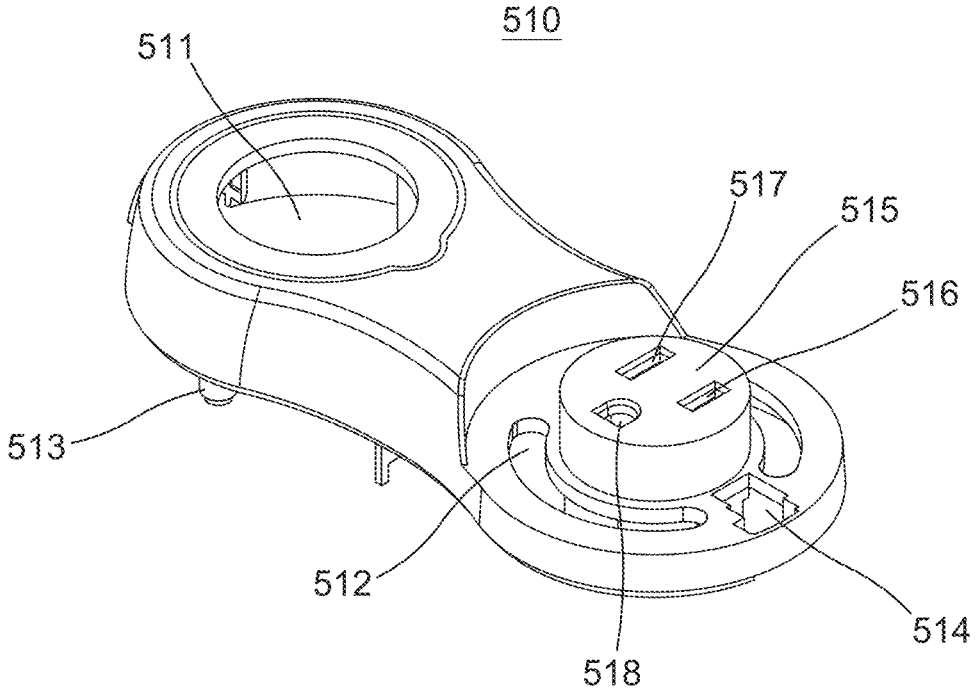
FIGS. 4A and 4B are top and bottom perspective views, respectively, of a top housing of a mechanical portion of the intermediate segment shown in FIG. 3A.
Figure 4B:
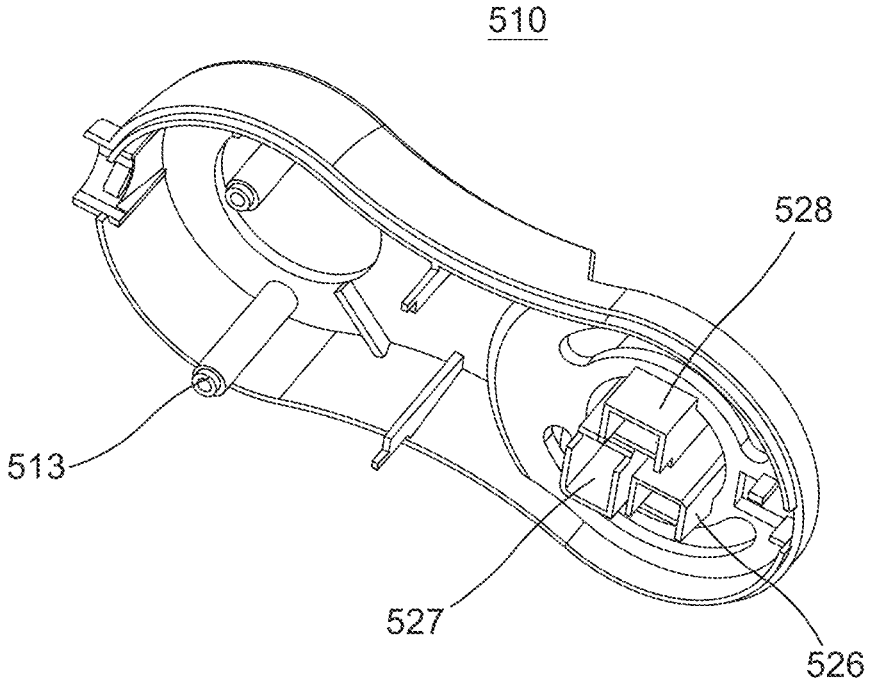
Figure 5A:
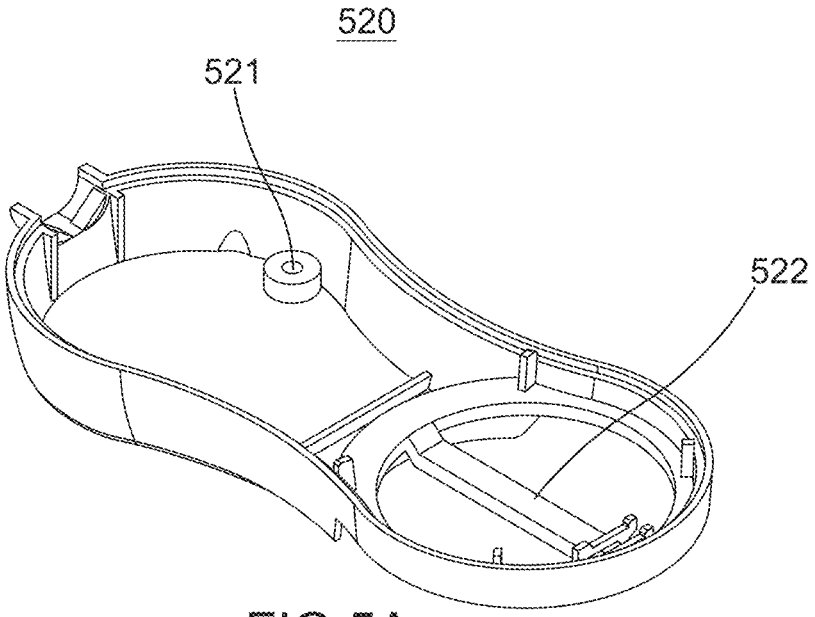
FIGS. 5A and 5B are top and bottom perspective views, respectively, of a bottom housing of the mechanical portion of the intermediate segment shown in FIG. 3A.
Figure 5B:
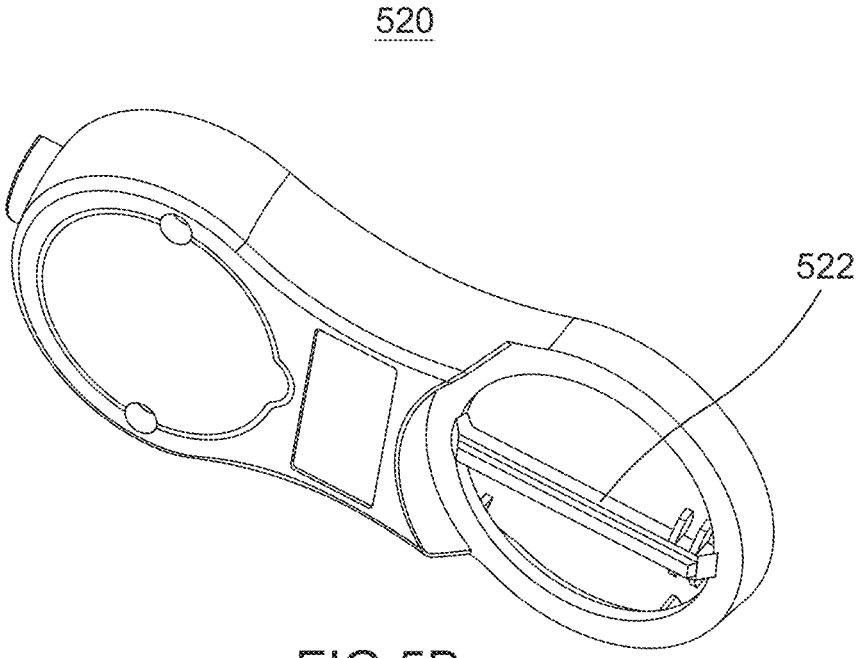

FIGS. 4A, 4B, 5A, and 5B depict mechanical portion 502 of intermediate segment 500. Specifically, FIG. 4A is a top perspective view of top housing 510, FIG. 4B is a bottom perspective view of top housing 510, FIG. 5A is a top perspective view of bottom housing 520, FIG. 5B is a bottom perspective view of bottom housing 520. Mechanical portion 501 of intermediate segment 500 is configured to movably connect intermediate segment 500 with a base segment, and/or a second intermediate segment, and/or a third intermediate segment. Specifically, intermediate segment 500 is pivotable about an axis perpendicular to a face 515 of intermediate segment 500. Mechanical portion 501 is configured to guide a device plug (not shown in FIGS. 3A-3C) of a device (not shown in FIGS. 3A-3C) into an outlet assembly 503 of intermediate segment 500. Mechanical portion 501 is also configured to mechanically connect the device plug to intermediate segment 500 via plug face 515 of outlet assembly 503.

Top housing 510 and bottom housing 520 of mechanical portion 501 are configured to combine to substantially enclose electrical portion 502. Top housing 510 includes an outlet aperture 511 configured to receive a portion of an outlet assembly of an adjacent intermediate segment. Top housing includes a contact aperture 514 configured to expose, or provide access to, a portion of electrical portion 502 to an electrical portion of an adjacent intermediate segment. In this manner, signals being conducted to and/or through intermediate segment 500 can be interconnected with the adjacent intermediate segment.

Top housing 510 includes a rotation track 512 and a rotation post 513. Rotation post 513 of intermediate segment 500 secures top housing 510 to bottom housing 520 via a rotation post anchor 521, and can be disposed through a rotation track of an adjacent base or intermediate segment, and, similarly, a rotation post of an another adjacent intermediate segment can be disposed through rotation track 512 of intermediate segment 500. Rotation post 513 of intermediate segment 500 and the rotation track of the adjacent base or intermediate segment can combine to define the range of relative rotational motion between the intermediate segment 500 and the adjacent base or intermediate segment, and the rotation post of the other adjacent intermediate segment and rotation track 512 of intermediate segment 500 can combine to define the range of relative rotational motion between the intermediate segment 500 and the other adjacent intermediate segment.

Top housing 510 includes a plug face 515. Plug face 515 includes a live receptacle 516, a neutral receptacle 517, and a ground receptacle 518. Each receptacle of outlet assembly 515 can be configured to direct and/or secure an associated mechanical portion of a device plug of an external device to and/or within intermediate segment 500. Each of live receptacle 516, neutral receptacle 517, and ground receptacle 518 includes a contact guide extending into intermediate segment 500, and configured to at least partially surround at least a portion of a live plug contact 543, a neutral plug contact 547, and a ground plug contact 552, respectively. In this manner, the receptacle can define the movement of the associated plug contact, as described herein. As shown in FIG. 4B, top housing 510 includes live contact guide 526, neutral contact guide 527, and ground contact guide 528.

Bottom housing 520 includes rotation post-anchor 521 and crossbar 522. Rotation post anchor 521 combines with rotation post 513 to secure top housing 510 to bottom housing 520. In some embodiments, a fastener, such as a screw (not shown), is disposed through rotation post anchor 521 and into rotation post 513 to secure top housing 510 to bottom housing 520. Crossbar 522 acts as a mechanical key to substantially maintain the position of outlet base portion 560 of outlet assembly 503 within mechanical portion 502. At least a portion of crossbar 522 can be disposed within a crossbar receiver 562 of outlet base portion 560.

Figure 6A:
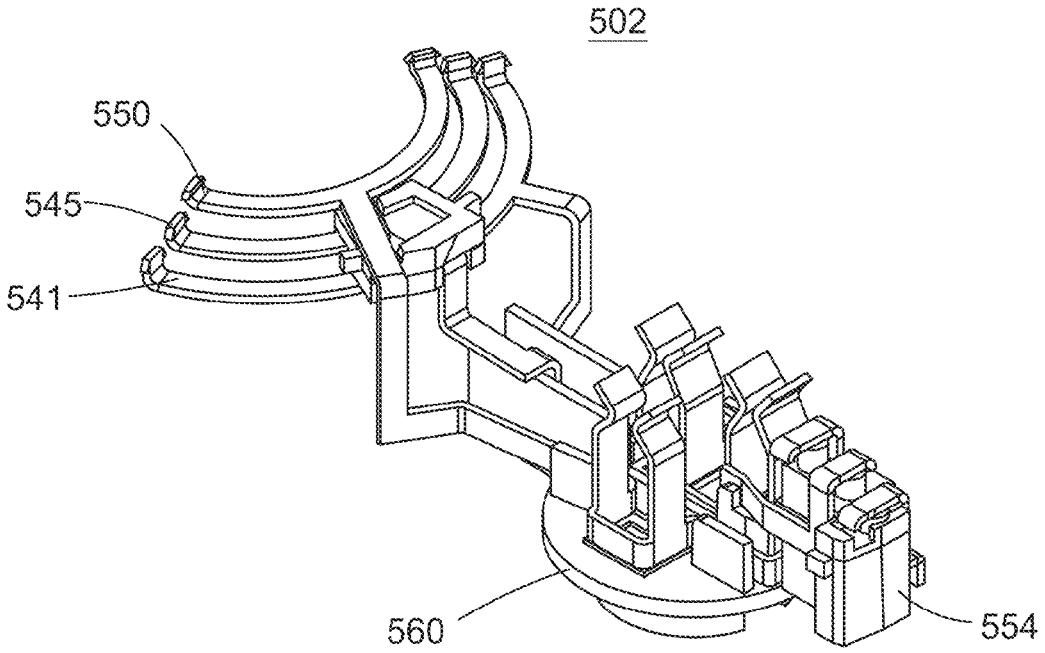
FIGS. 6A and 6B are perspective views of an electrical portion of the intermediate segment shown in FIG. 3A.
Figure 6B:
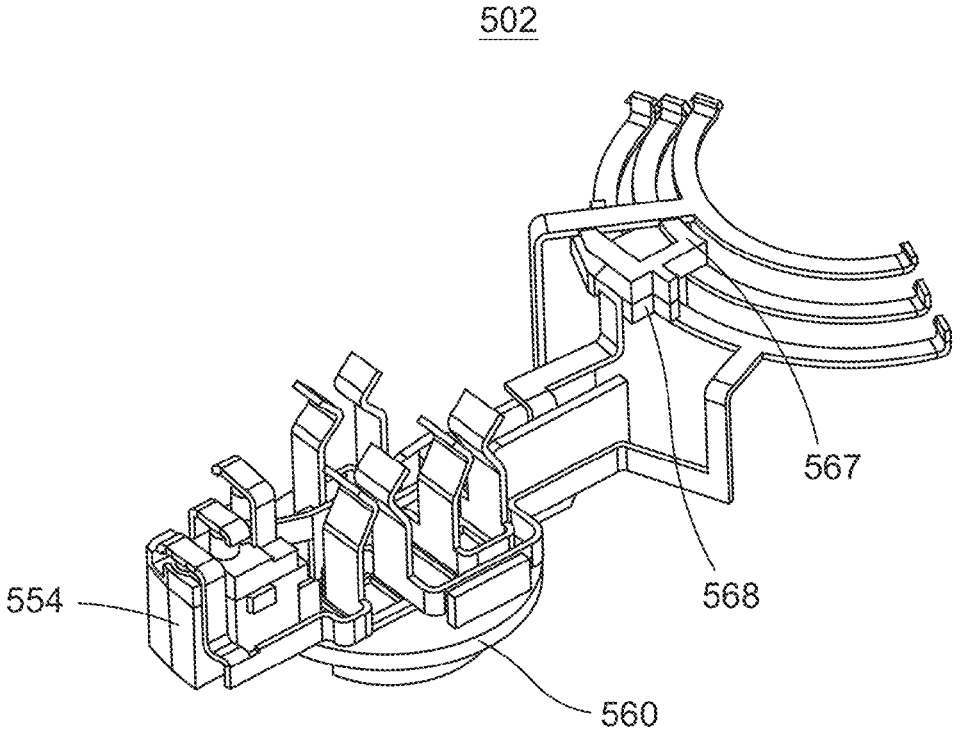

FIG. 6A and FIG. 6B depict electrical portion 502. Electrical portion 502 is configured to define a conductive, or power, path between intermediate segment 500 and a power source (not shown in FIGS. 3A-3C), and to define a power path between other intermediate segments and the power source. Specifically, electrical portion 502 is configured to define the power path between outlet assembly 503 of intermediate segment 500 and/or an outlet assembly of another intermediate segment with the signal port.

Electrical portion 502 is substantially disposed within mechanical portion 501. A portion of electrical portion 502 is exposed through, or disposed slightly outside of, mechanical portion 501 via contact aperture 514. In this manner, electrical portion 502 of intermediate segment 500 can interconnect with an electrical portion of an adjacent intermediate segment via contact aperture 514. Electrical portion 502 can combine with the electrical portions of the other segments of plug strip 400. Electrical portion 502 includes a live connector 541 configured to interconnect a live signal from a signal port (see FIGS. 8A-8C), a neutral connector 545 configured to interconnect a neutral signal from the signal port (see FIGS. 9A-9C), and a ground connector 550 configured to interconnect a ground signal from the signal port (see FIGS. 10A-10C). Electrical portion 502 includes outlet base portion 560 (see FIGS. 11A-11C), a contact tensioning assembly 554 (see FIGS. 12A-12D), a first contact track holder 567 (see FIGS. 13A-13D), and a second contact track holder 568 (see FIGS. 14A-14B).

Returning to FIG. 3C, outlet assembly 503 includes element and/or portions of elements of mechanical portion 501 and electrical portion 502. Outlet assembly 503 includes plug face 515, including live receptacle 516, neutral receptacle 517, and ground receptacle 518; outlet base portion 560; and live plug contact 543, neutral plug contact 547, and ground plug contact 552. Outlet assembly 503 can be configured to mechanically direct and/or secure a mechanical portion of a device plug of an external device to and/or within intermediate segment 500, and can be configured to electrically direct and/or secure an electrical portion of a device plug of an external device to and/or within intermediate segment 500.

Figure 8B:
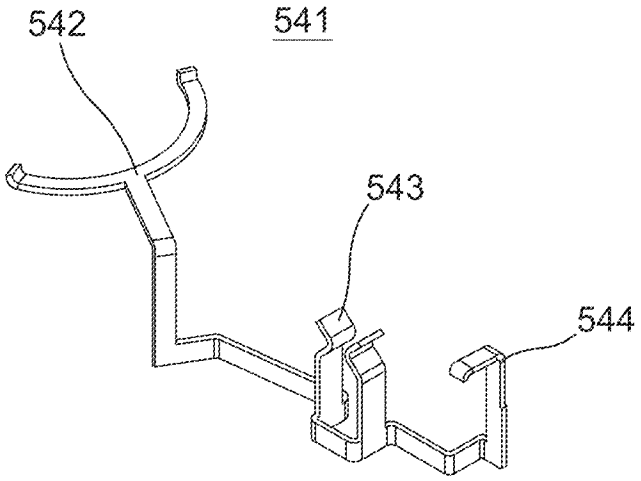
FIGS. 8A-8C are top, perspective, and side views, respectively, of a first connector of the electrical portion shown in FIG. 6A.
Figure 8A:
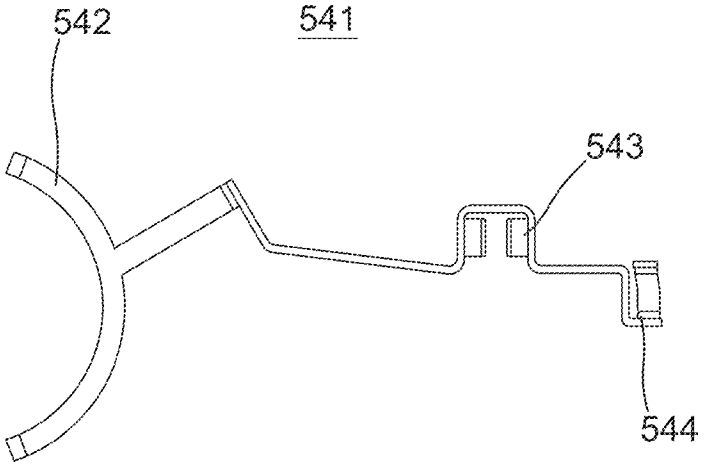
Figure 8C:
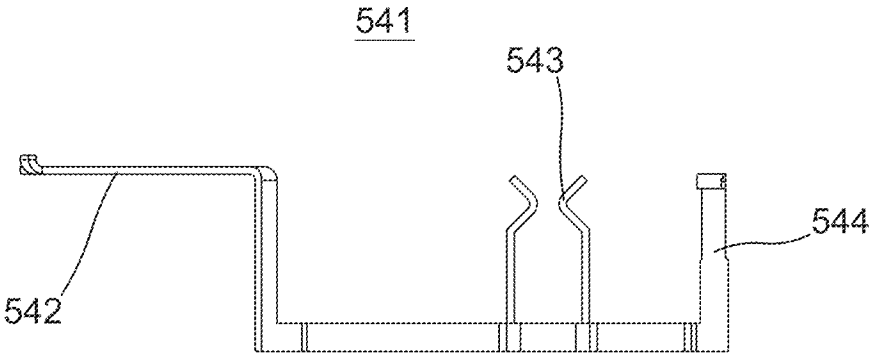
Figure 9B:
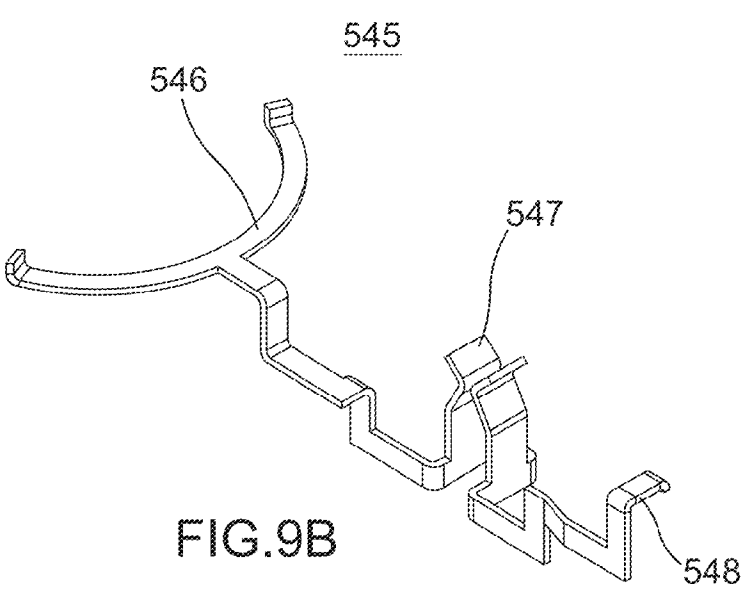
FIGS. 9A-9C are top, perspective, and side views, respectively, of a second connector of the electrical portion shown in FIG. 6A.
Figure 9A:
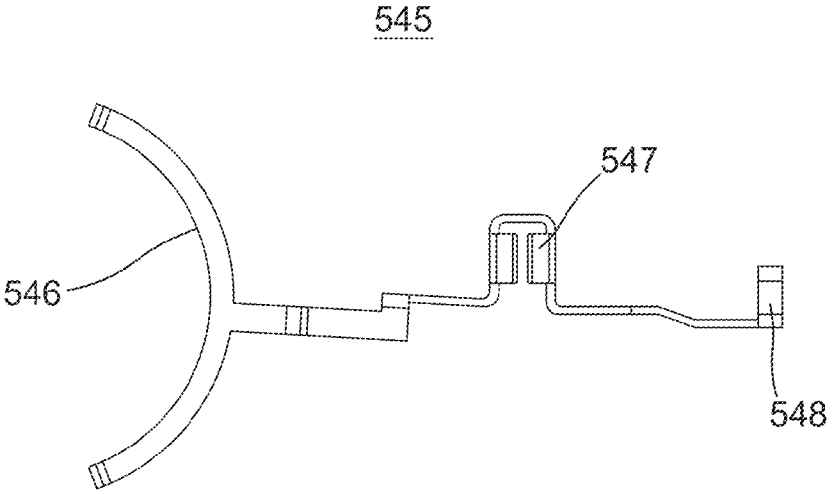
Figure 9C:
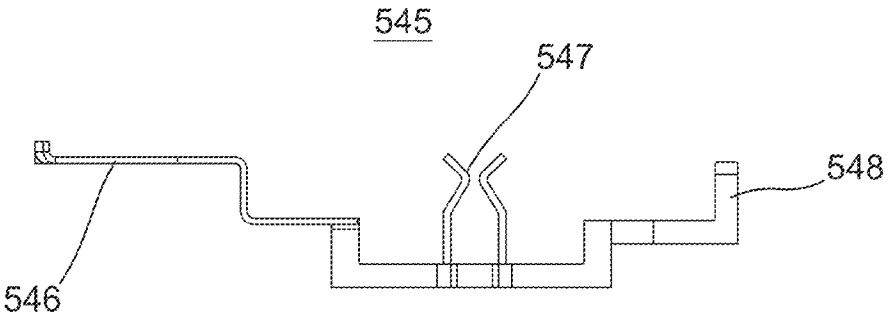
Figure 10B:
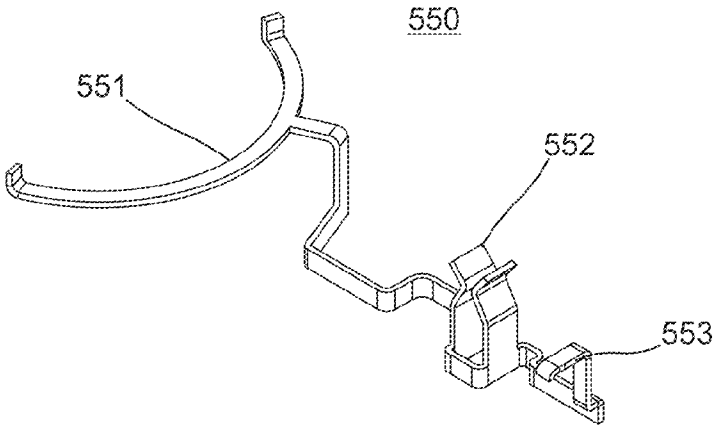
FIGS. 10A-10C are top, perspective, and side views, respectively, of a third connector of the electrical portion shown in FIG. 6A.
Figure 10A:
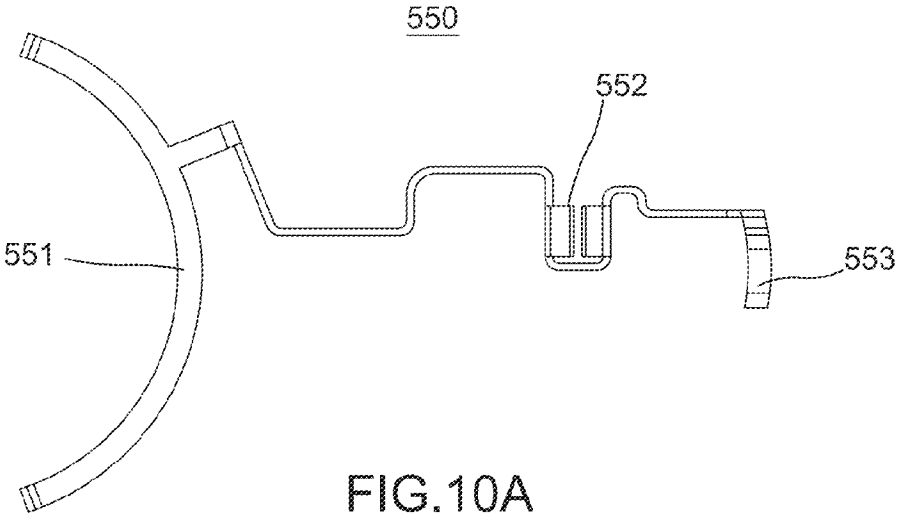
Figure 10C:
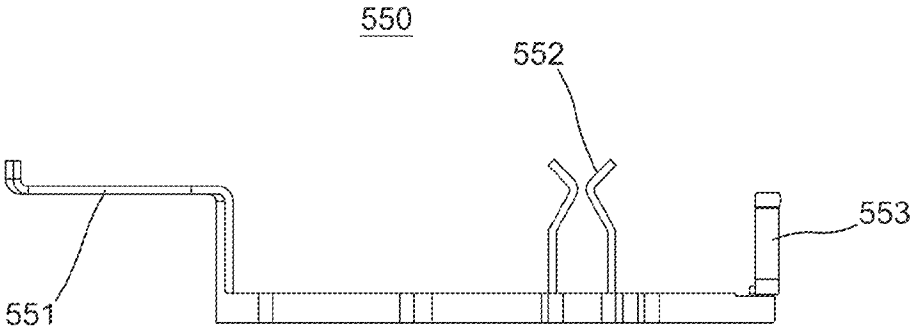

FIGS. 8A-8C depict live connector 541, FIGS. 9A-9C depict neutral connector 545, and FIGS. 10A-10C depict ground connector 550. Each of live connector 541, neutral connector 545, and ground connector 550, collectively "the connectors," are configured to define a portion of a power path between the power source and an adjacent base segment, an adjacent intermediate segment, and/or an a device plug. The connectors includes a track configured to be operatively coupled with a contact of a connector of an adjacent segment, and can be configured to receive a signal from and/or send a signal to, the contact of that connector of the adjacent segment. The track can be dimensioned to allow the track contact of the adjacent segment to maintain contact with the track through the entire range of motion of intermediate segment 500 relative to the adjacent segment. The connectors include a plug contact configured to operatively couple with an electrical portion of a device plug of a device external to the plug strip 400, and to receive a signal from and/or send a signal to, the device. In some embodiments, the plug contact can be configured to impart a mechanical force on the device plug to hold the device plug in place within outlet assembly 503. A portion of the plug contact is disposed within a receptacle of plug face 515. As discussed above, the guide of a receptacle can define the motion of the plug contact. The connector includes a track contact configured to operatively couple with a track of a connector of the other segment, and can be configured to receive a signal from and/or send a signal to, the track of that connector of the other segment. As discussed in more detail below, contract tensioning assembly 554 can act on the track contact to maintain contact between the track contact and the track of the other segment when intermediate segment 500 and the other segment are at rest and/or moving relative to one another.

FIGS. 8A-8C depict live connector 541 of electrical portion 502 of intermediate segment 500. Specifically, FIG. 8A is a top view, FIG. 8B is a front view, and FIG. 8C is a perspective view. Live connector 541 includes a live track 542, a live plug and a live track contact 544. FIGS. 9A-9C depict neutral connector 541 of electrical portion 502 of intermediate segment 500. Specifically, FIG. 9A is a top view, FIG. 9B is a front view, and FIG. 9C is a perspective view. Neutral connector 545 includes a neutral track 546, a neutral plug contact 547, and a neutral track contact 548. FIGS. 10A-10C depict ground connector 541 of electrical portion 502 of intermediate segment 500. Specifically, FIG. 10A is a top view, FIG. 10B is a front view, and FIG. 10C is a perspective view. Ground connector 550 includes a ground track 551, a ground plug contact 552, and a ground track contact 553.

Figure 11B:
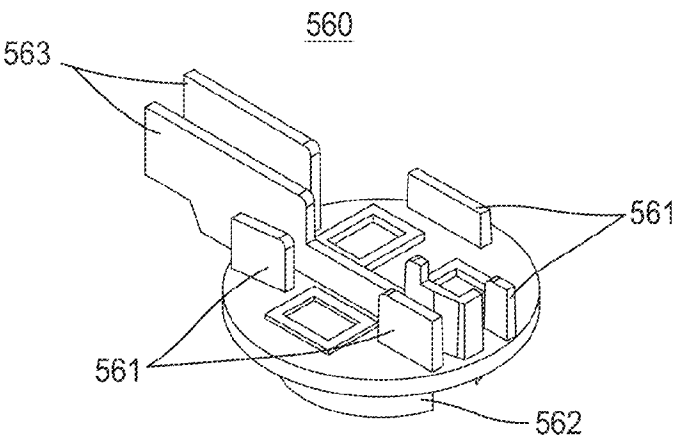
FIGS. 11A-11D are top, perspective, bottom, and side views, respectively, of an outlet base portion of the electrical portion shown in FIG. 6A.
Figure 11D:
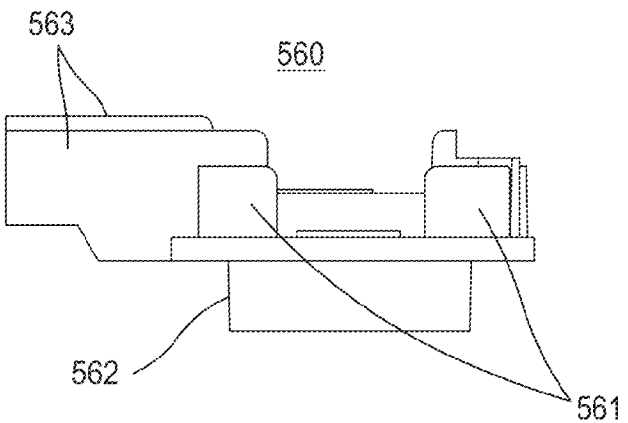
Figure 11A:
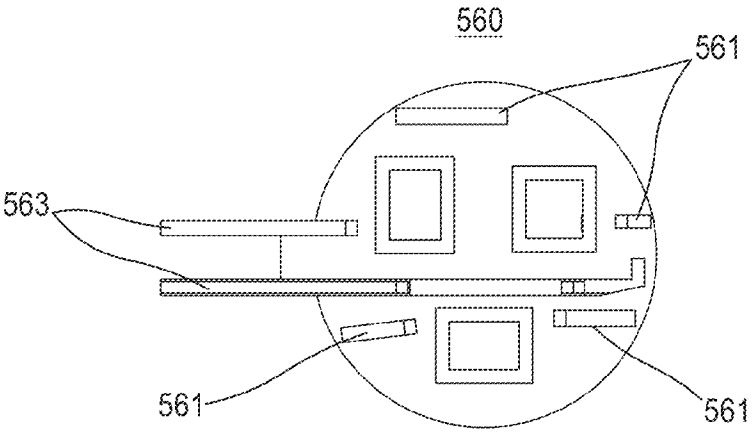
Figure 11C:
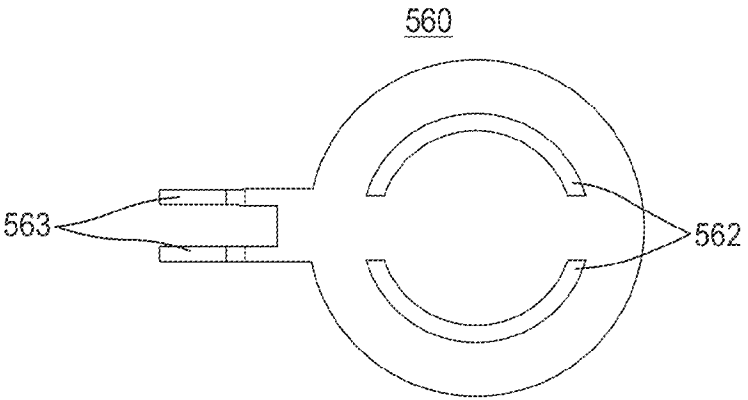

FIGS. 11A-11D depict outlet base portion 560 of electrical portion 502 of intermediate segment 500. Specifically, FIG. 11A is a top view, FIG. 11B is a perspective view, FIG. 11C is a bottom view, and FIG. 11D is a front view. Outlet base portion 560 combines with plug face 515 and outlet electrical portion 565 to form outlet assembly 503. Outlet base portion 560 includes insulation members 561, support members 563, and a crossbar receiver 562. Support members 563 are configured to support live connector 541, neutral connector 545, and ground connector 550, and insulation members 561 are configured to insulate each of those connectors from one another, and from the other elements of intermediate segment 500. Each of the insulation members 561 can be shaped based on the physical characteristics of the associated connector.

Figure 12B:
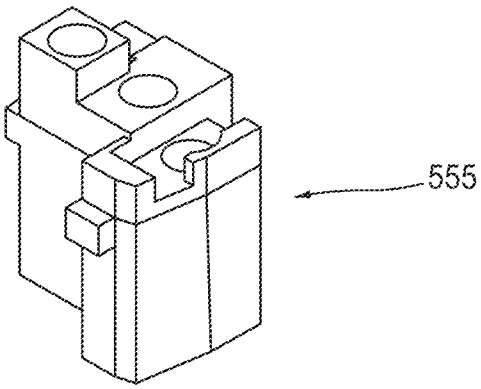
FIG. 12B is a perspective view of a contact tensioning housing of the contact tensioning assembly shown in FIG. 12A.
Figure 12D:
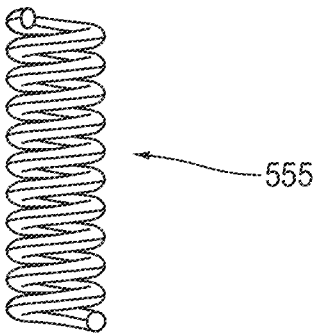
FIG. 12D is a perspective view of a contact spring of the contact tensioning assembly shown in FIG. 12A.
Figure 12A:
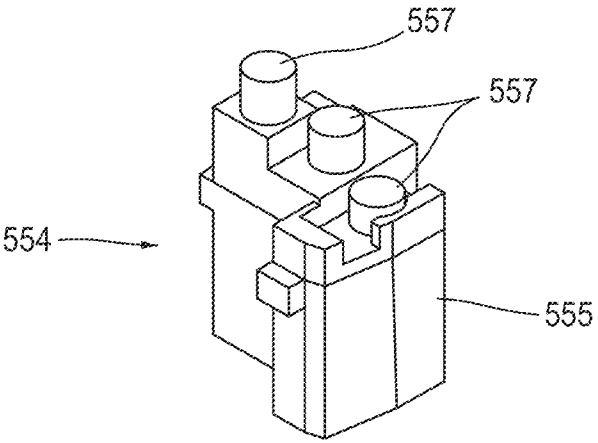
FIG. 12A is a perspective view of a contact tensioning assembly of the electrical portion shown in FIG. 6A.
Figure 12C:
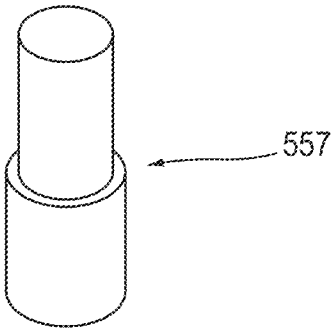
FIG. 12C is a perspective view of a contact spring cap of the contact tensioning assembly shown in FIG. 12A.

FIGS. 12A-12D depict contact tensioning assembly 554. Specifically, FIG. 12A is a perspective view of a contact tensioning assembly 554, FIG. 12B is a perspective view of contact tensioning housing 555, FIG. 12C is a perspective view of contact spring cap 556, and FIG. 12D is a front view of contact spring 557. Contact tensioning assembly 554 includes the contact tensioning housing 555, three contact springs 556 (see FIG. 3C), and three contact caps 557 (see FIG. 3C). Each contact spring 556 is paired with a contact cap 557. In some embodiments, contact tensioning assembly 554 can include more or fewer contact springs 556 and/or contact caps 557, depending on the number of connectors included in intermediate segment 500. Contact tensioning housing 555 includes three spring cavities 558 configured to receive and/or support a contact spring 556 and contact cap 557 pair. Contact tensioning housing, contact springs 556, and/or contact spring caps 557 are configured to maintain electrical isolation of each of live connector 541, neutral connector 545, and ground connector 550. Each contact spring 556 is compressed to impart a resilient force on an associated contact spring cap 557 and contact tensioning housing 555. Each contact spring cap 557 is configured to transfer the force imparted on that contact spring cap 557 to an associated connector.

Figure 13A:
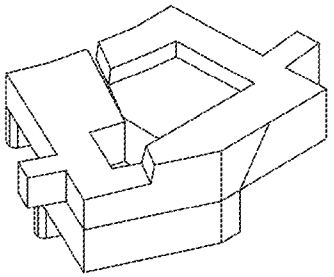
FIGS. 13A-13D are perspective, side, bottom, and top views, respectively, of a contact track holder of the electrical portion shown in FIG. 6A.
Figure 13B:
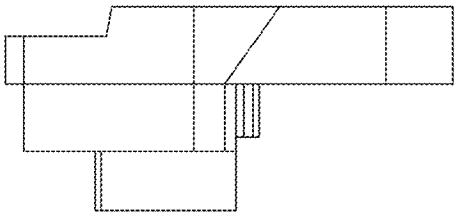
Figure 13C:
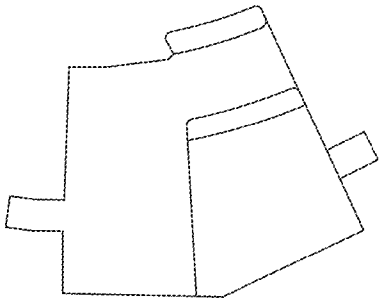
Figure 13D:
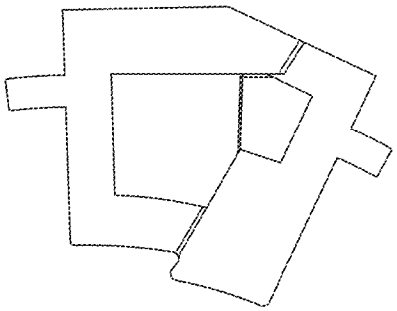
Figure 14B:
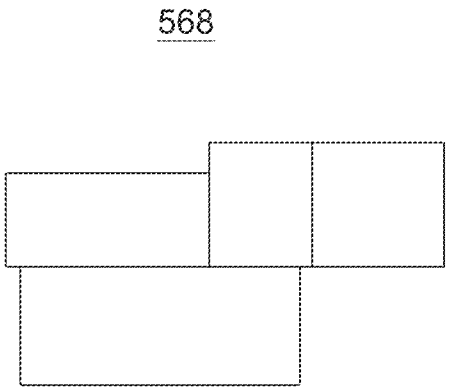
FIGS. 14A-14B are perspective and side views, respectively, of another contact track holder of the electrical portion shown in FIG. 6A.
Figure 14A:
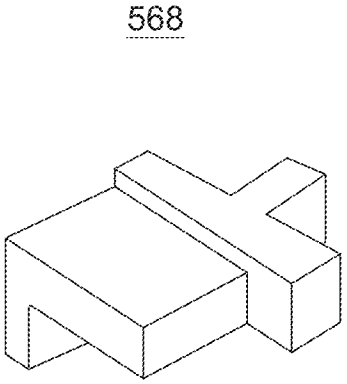

FIGS. 13A-13D depict contact track holder 567, and FIGS. 14A and 14B depict contract track holder 568. Specifically, FIG. 13A is a perspective view of contact track holder 567, FIG. 13B is a front view of contract track holder 567, FIG. 13C is a bottom view of contact track holder 567, and FIG. 13D is a top view of contact track holder 567. FIG. 14A is a perspective view of floating insulation member 568, and FIG. 14B is a front view of floating insulation member 568. Each of contact track holder 567 and contact track holder 568 is configured to electrically isolate and/or support at least one of live connector 541, neutral connector 545, and ground connector 550, from one another and/or relative to one another, and from the other elements of intermediate segment 500. Similar to insulation members 561 of outlet base portion 560, contact track holder 567 and contact track holder 568 is shaped based on the physical characteristics of the associated connector and/or depending on the number of connectors included in intermediate segment 500. In some embodiments, more or fewer insulation members can be included in electrical portion 502 of intermediate segment 500 depending on the physical characteristics and/or depending on the number of connectors.

Figure 15A:
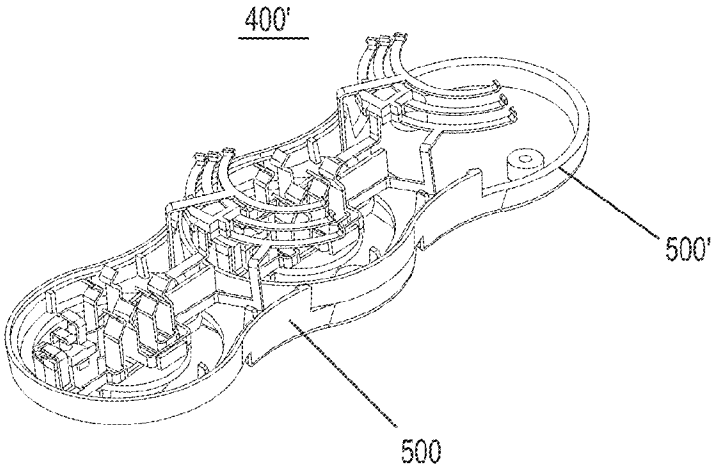
FIG. 15A is a perspective view of a portion of two interconnected segments of the plug strip shown in FIG. 2A, in a first configuration.
Figure 15B:
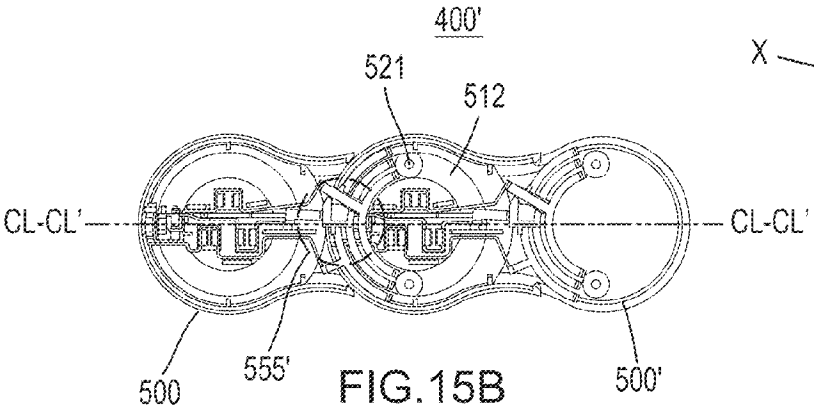
FIG. 15B is a top view of the portion of the two interconnected segments shown in FIG. 15A, in the first configuration.
Figure 15C:
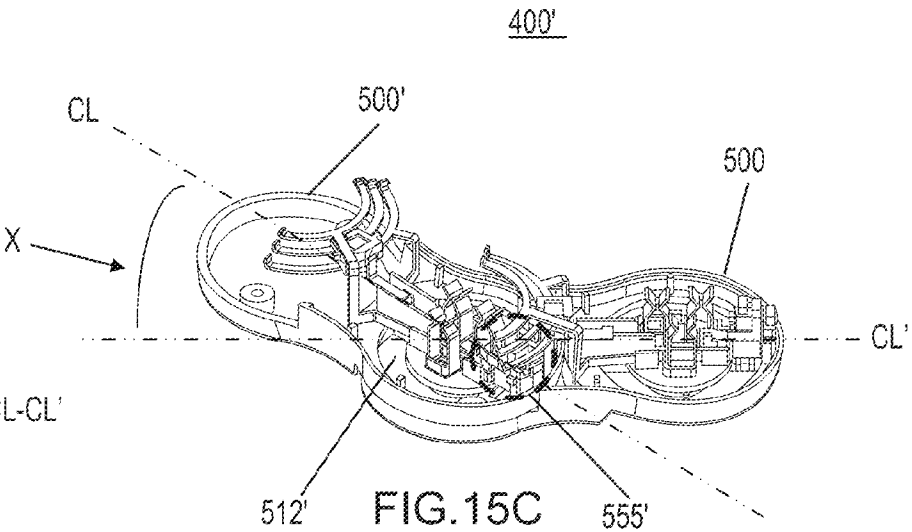
FIG. 15C is a perspective view of the portion of the two interconnected segments shown in FIG. 15A, in a second configuration.
Figure 16A:
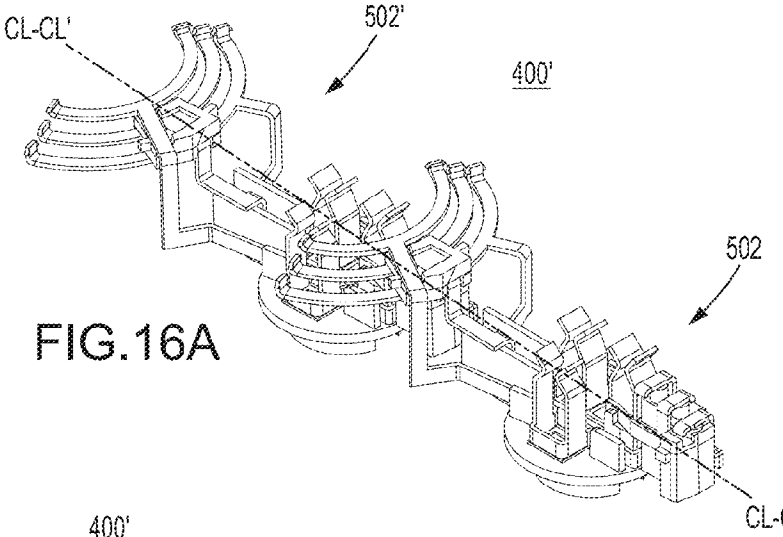
FIG. 16A is a top perspective view of the electrical portion of two interconnected segments of the plug strip shown in FIG. 2A, in a first configuration.
Figure 16B:
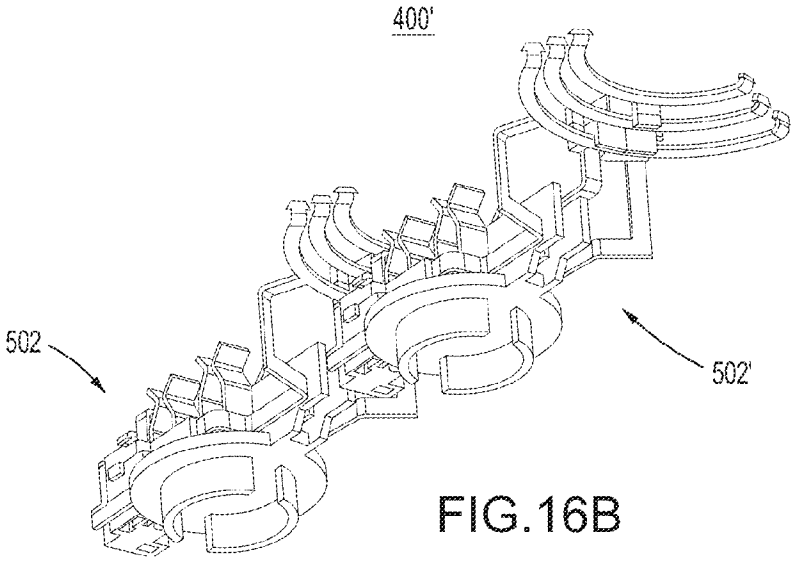
FIG. 16B is a bottom perspective view of the portion of the two interconnected segments shown in FIG. 16A, in the first configuration.
Figure 16C:
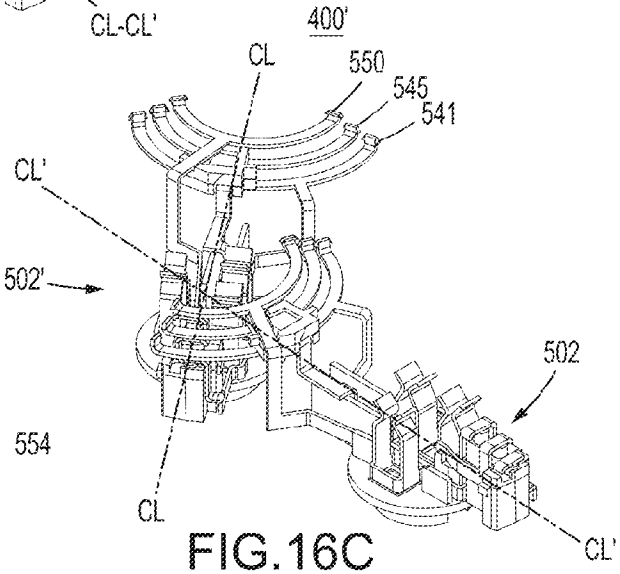
FIG. 16C is a perspective view of the portion of the two interconnected segments shown in FIG. 16A, in a second configuration.

FIGS. 15A-15C, and FIGS. 16A-16C depict portions of a first intermediate segment 500 interconnected with portions of a second intermediate segment 500', collectively "plug strip portion 400'." FIGS. 15A-15C show a portion of mechanical portions 501, 501' and electrical portions 502, 502' (the top housings of mechanical portions 501, 501' having been removed to better see the interconnection between mechanical portions 501, 501' and electrical portions 502, 502'). FIGS. 15A and 16A are perspective views of plug strip portion 400' in a first configuration (straight), shown with and without bottom housings 520, respectively, FIGS. 15B and 16B are top views of plug strip portion 400' in the first configuration, and FIGS. 15C and 16C are perspective views of plug strip portion 400' in a second configuration (rotated).

As shown in FIGS. 15A-15C, intermediate segment 500 includes a centerline CL, intermediate segment 500' includes a centerline CL'. Intermediate segment 500 and intermediate segment 500' are rotatable relative to each other about axis A from the first configuration, (e.g. when the angle between centerline CL and centerline CL' is zero degrees, FIG. 15B), to the second configuration, (e.g. when the angle between centerline CL and centerline CL' is X, FIG. 15C). The maximum angle X is defined or limited by the rotation track 812' and the rotation post 513 (not shown in FIGS. 15A-15C) of intermediate segment 500 and rotation post anchor 521 of intermediate segment 500'. As intermediate segment 500 is moved relative to intermediate segment 500', the rotation post moves within the rotation track 512' and track contacts 543', 547', 552' of intermediate segment 500' move in constant physical and electrical contact with tracks 541, 545, 550 of intermediate segment 500 until relative movement is manually stopped and/or automatically stopped (e.g. maximum angle X is reached).

FIGS. 16A-16C show electrical portions 502, 502' of plug strip portion 400'. As shown in FIGS. 16A-16C, electrical portion 502 includes a centerline CL and electrical portion 502' includes a centerline CL'. Electrical portion 502 and electrical portion 502' are rotatable relative to each other from the first configuration, (e.g. when the angle between centerline CL and centerline CL' is zero degrees, FIG. 16A), to the second configuration, (e.g. when the angle between centerline CL and centerline CL' is X, FIG. 16C). The maximum angle X is defined by a tracks 541, 545, 550 of electrical portion 502 and by contact tensioning assembly 554' of electrical portion 502'. As electrical portion 502 is moved relative to electrical portion 502, the track contacts 543', 547', 552' of electrical portion 502' move in constant contact with tracks 541, 545, 550 of electrical portion 502 until relative movement is manually stopped and/or automatically stopped (e.g. maximum angle X is reached). During relative rotation, contact tensioning assembly 854 maintains contact between track contacts 543', 547', 552' and tracks 541, 545, 550.

Figure 17A:
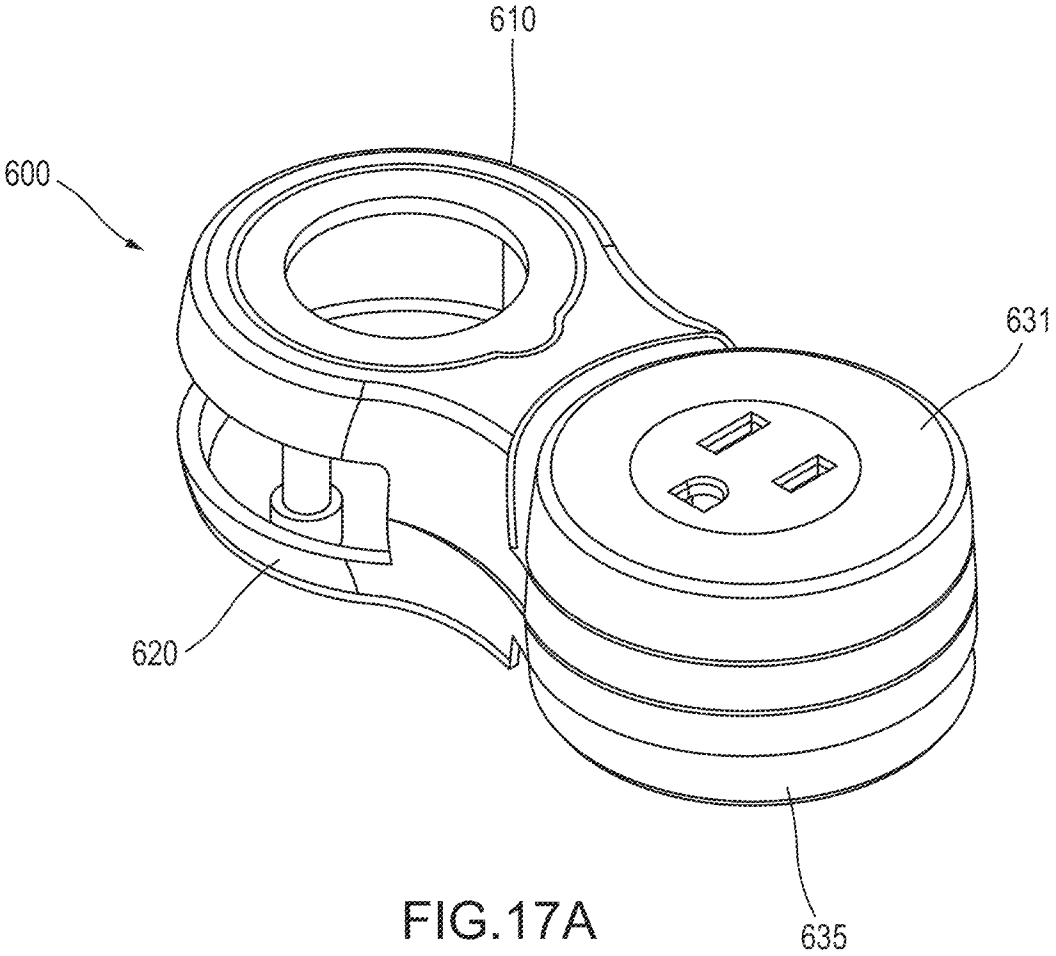
FIG. 17A is a perspective view of an end segment of the plug strip shown in FIG. 2A.
Figure 17B:
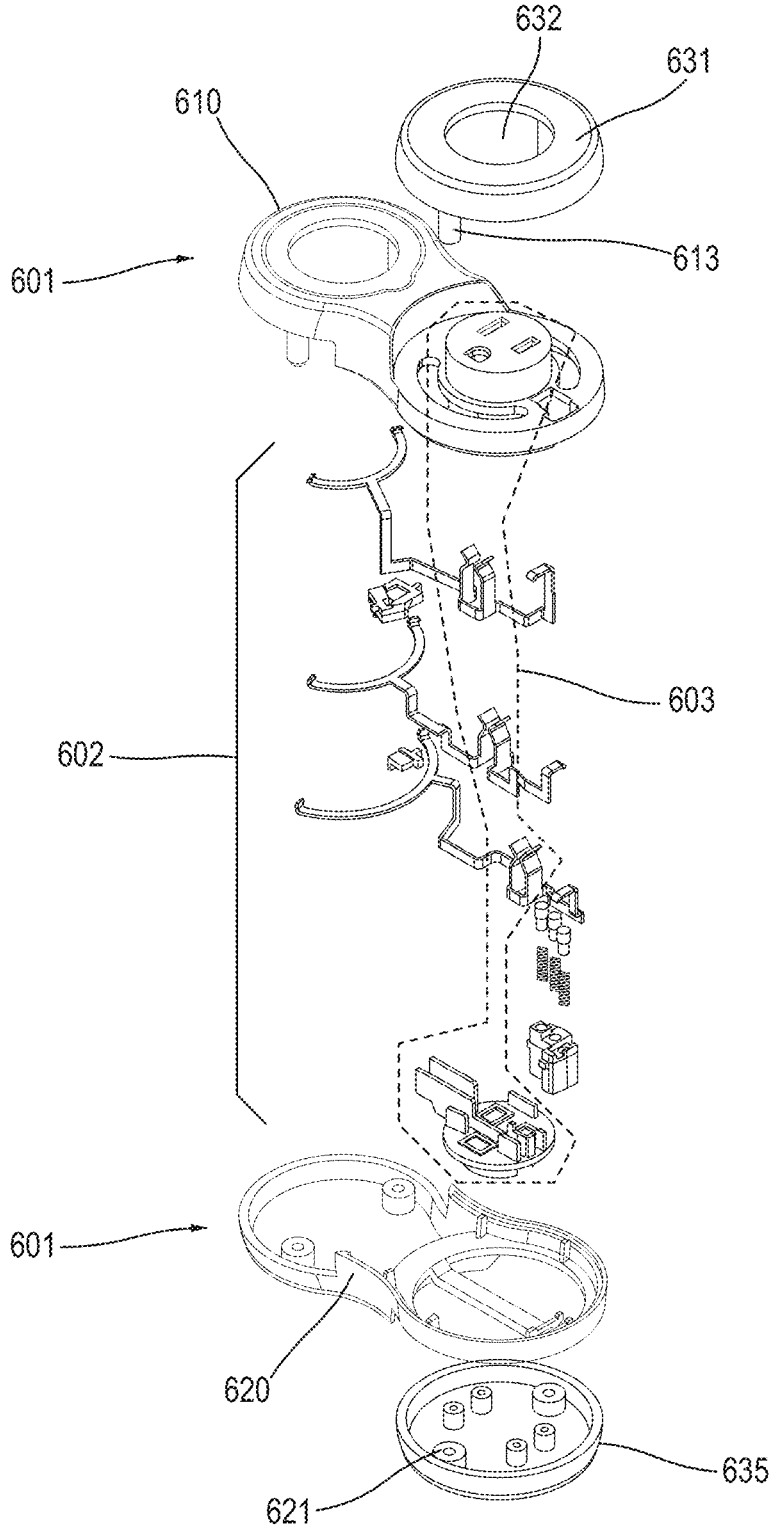
FIG. 17B is an exploded perspective view of the end segment shown in FIG. 17A.

A terminal or end segment of a plug strip can be substantially the same as an intermediate segment. By way of example, the end segment can include a mechanical portion, an electrical portion, and an outlet portion. In contrast to an intermediate segment, the end segment can include caps to substantially enclose a portion of the end segment that would otherwise be interconnected with an adjacent other intermediate segment. FIGS. 17A and 17B depict an end segment 600. End segment 600 can be similar to intermediate segment 500 described above and can includes similar components. By way of example, end segment 600 includes a mechanical portion 601 including a top housing 610 and a bottom housing 620 (similar to mechanical portion 501), an electrical portion 602 (similar to electrical portion 502), and an outlet portion 603 (similar to outlet portion 503). In contrast to intermediate segment 500, end segment 600 includes an end housing 630 including a top cap 631 and a bottom cap 635. Top cap 631 includes a plug aperture 632 and rotation posts 613, and bottom cap 635 includes rotation post anchors 621.

Figure 18A:
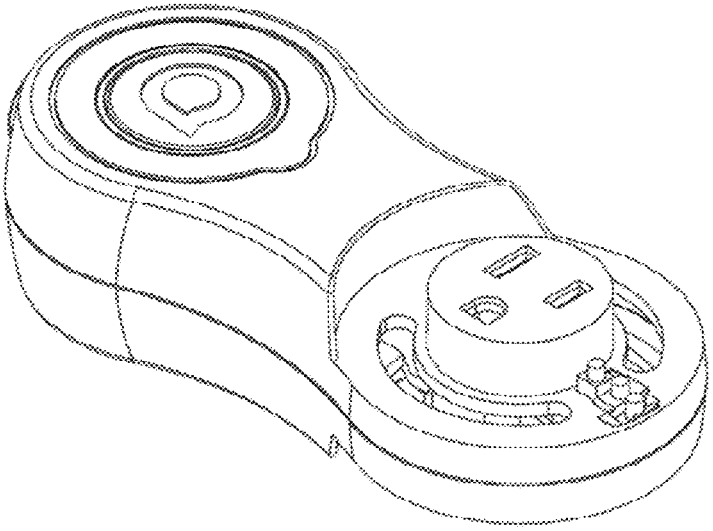
FIG. 18A is a perspective view of a base segment of the plug strip shown in FIG. 2A.
Figure 18E:
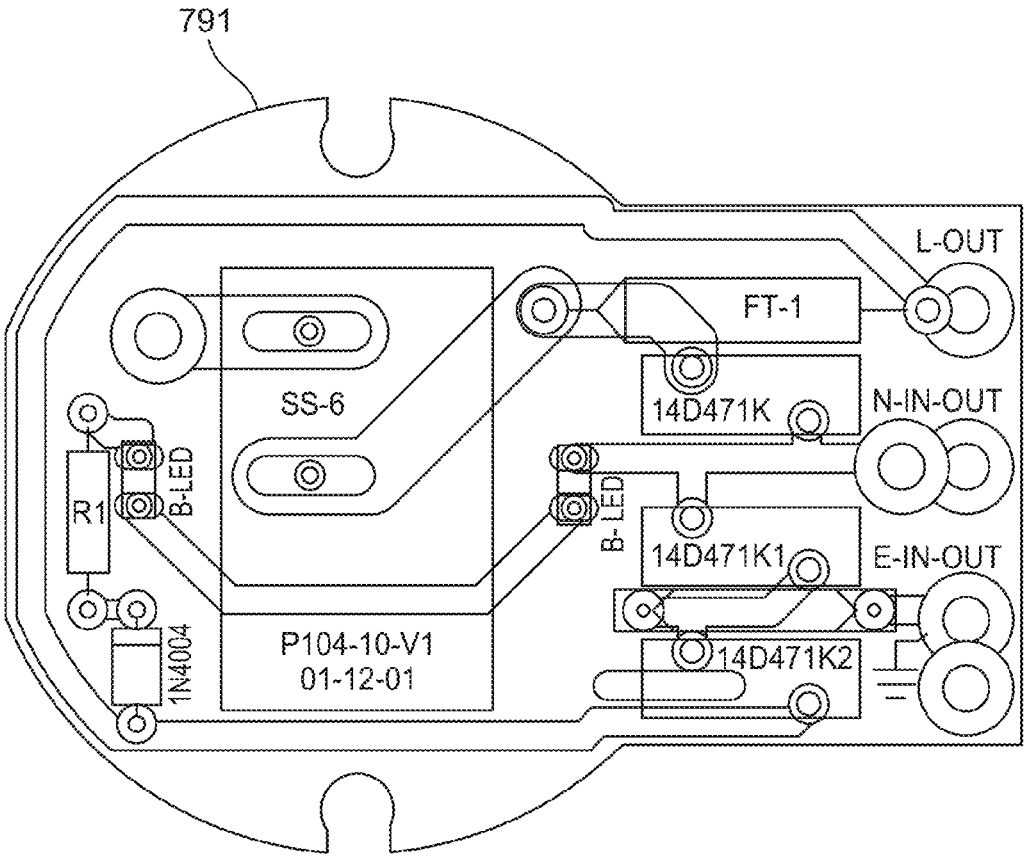
FIG. 18E is an electrical schematic diagram of a printed circuit board of the base segment shown in FIG. 18B.
Figure 18B:
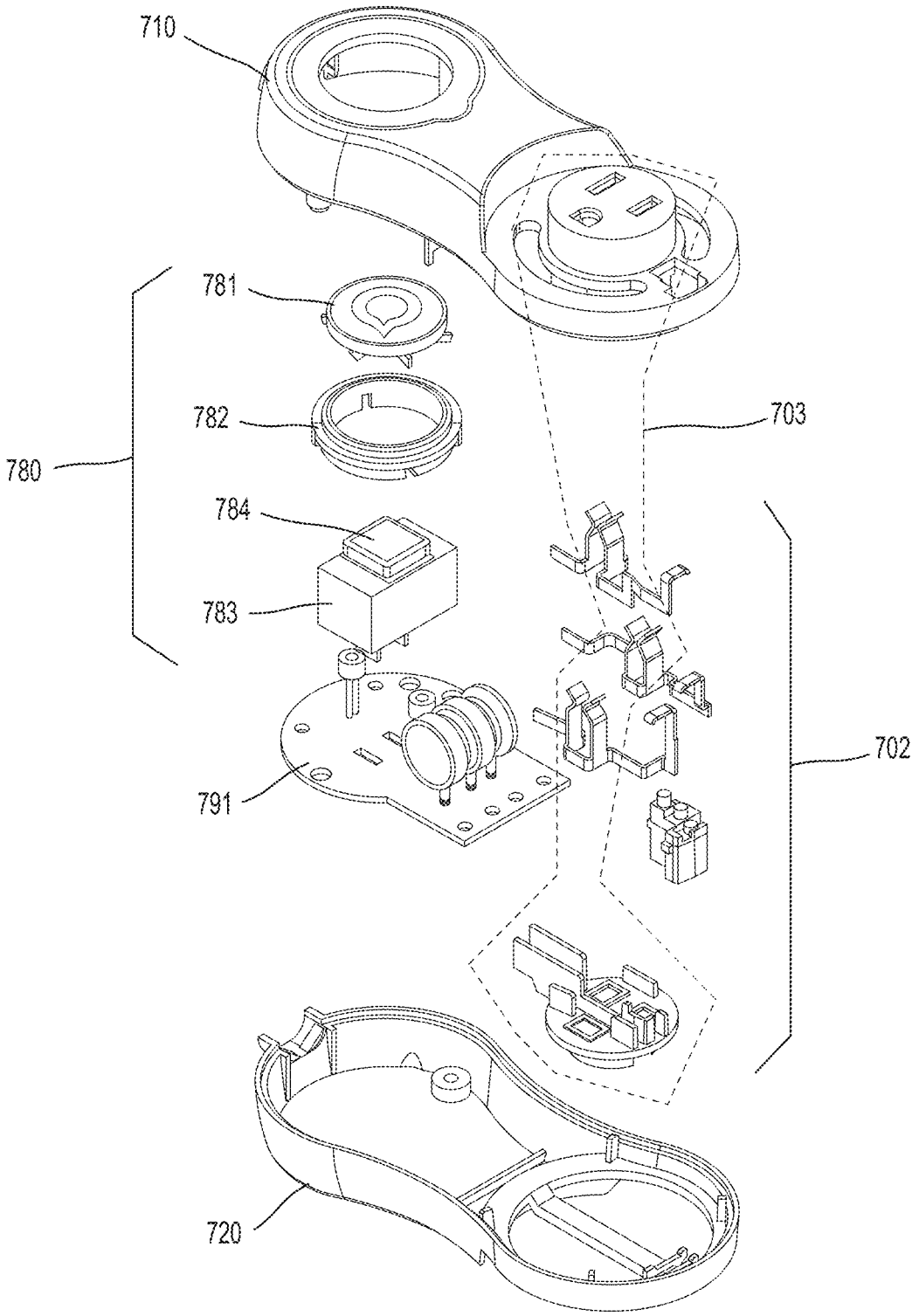
FIG. 18B is an exploded perspective view of the base segment shown in FIG. 18A.
Figure 18C:
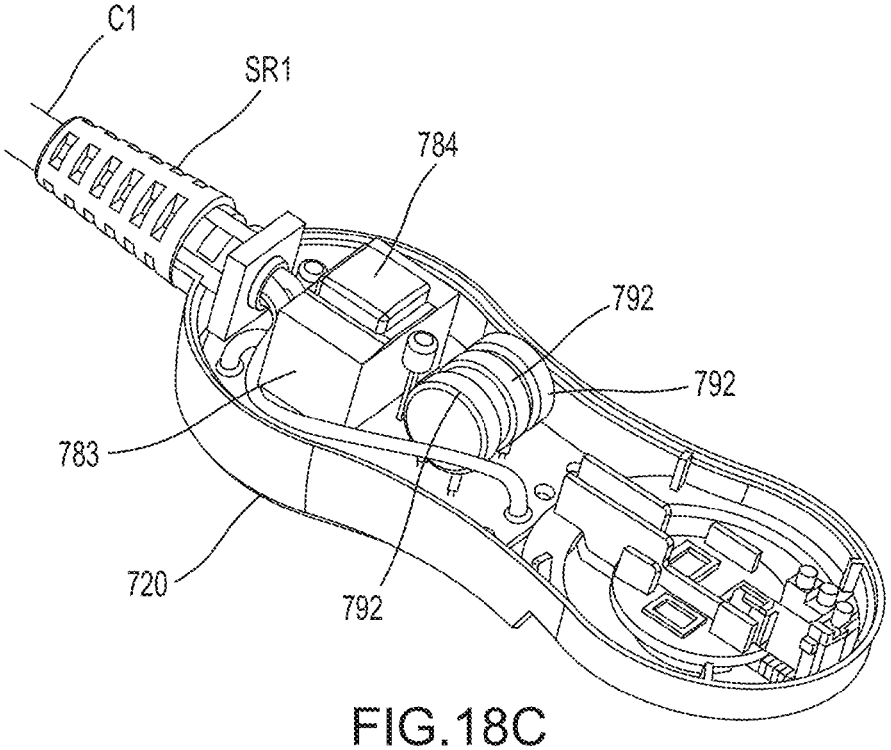
FIG. 18C is a perspective view of a portion of the base segment shown in FIG. 18A.
Figure 18D:
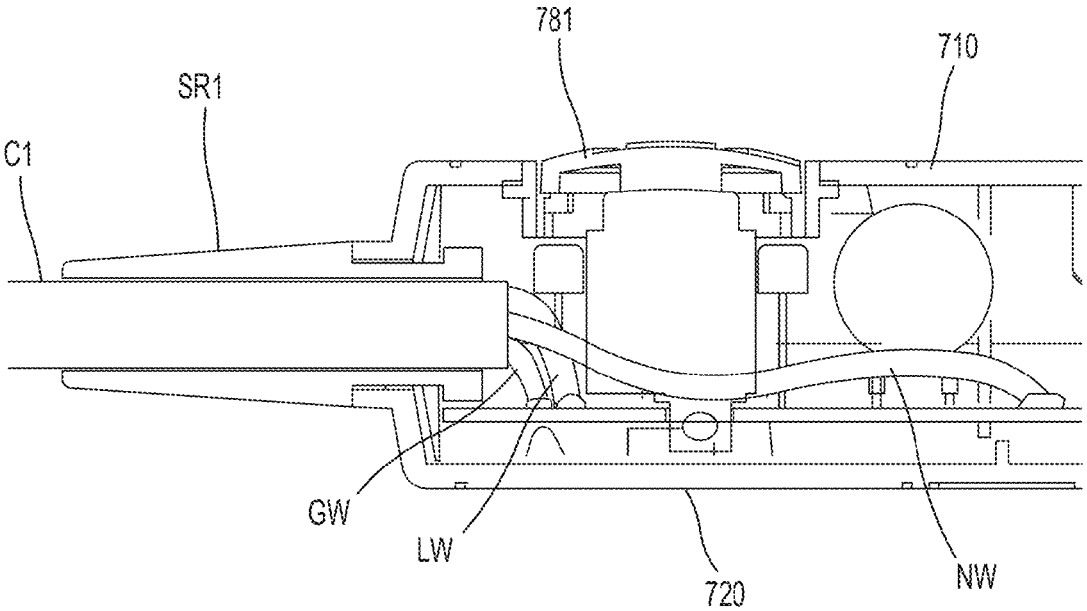
FIG. 18D is a side cross-sectional view of a portion of the base segment shown in FIG. 18A.

A base segment of a plug strip is substantially the same as an intermediate segment. By way of example, the base segment includes a mechanical portion, an electrical portion, and an outlet portion. In contrast to an intermediate segment, the base segment includes a switch assembly to allow a user to selectively electrically couple a power source to the outlets of the power strip. FIGS. 18A-18D depict a base segment 700, and FIG. 18E is an electrical schematic diagram of a printed circuit board. Base segment 700 is similar to intermediate segment 500 described above and includes similar components. By way of example, base segment 700 includes a mechanical portion 701 including a top housing 710 and a bottom housing 720 (similar to mechanical portion 501), an electrical portion 702 (similar to electrical portion 502), and an outlet portion 703 (similar to outlet portion 503). In contrast to intermediate segment 500, base segment 700 includes a switch assembly 780, and a printed circuit board 791. Switch assembly 780 includes switch 781, a switch bracket 782, a switch circuit 783, and an indicator 784. Switch 781 is a mechanical means of engaging and/or disengaging switch circuit 783, and is supported by switch bracket 782. Indicator 784 is a visual element configured to indicate when a switch circuit is engaged and/or disengaged. By way of example, indicator 784 illuminates when switch circuit 783 is engaged and may not illuminate when switch circuit 783 is disengaged. Indicator 784 and/or an indication from indicator 784 is configured to be visible via switch 781.

Printed circuit board 791 is configured to selectively interconnect electrical portion 702 with a cord C1, and to be operable by switch assembly 780. The printed circuit board 791 can also provide surge protection to plug strip 400. In such embodiments, printed circuit board 791 can include varistors 792, such as, for example, metal oxide varistors to provide the surge protection. Cord C1 includes a live wire LW, a neutral wire NW, and a ground wire GW, and is disposed in base segment 700 through a strain relief SR.

Figure 7:
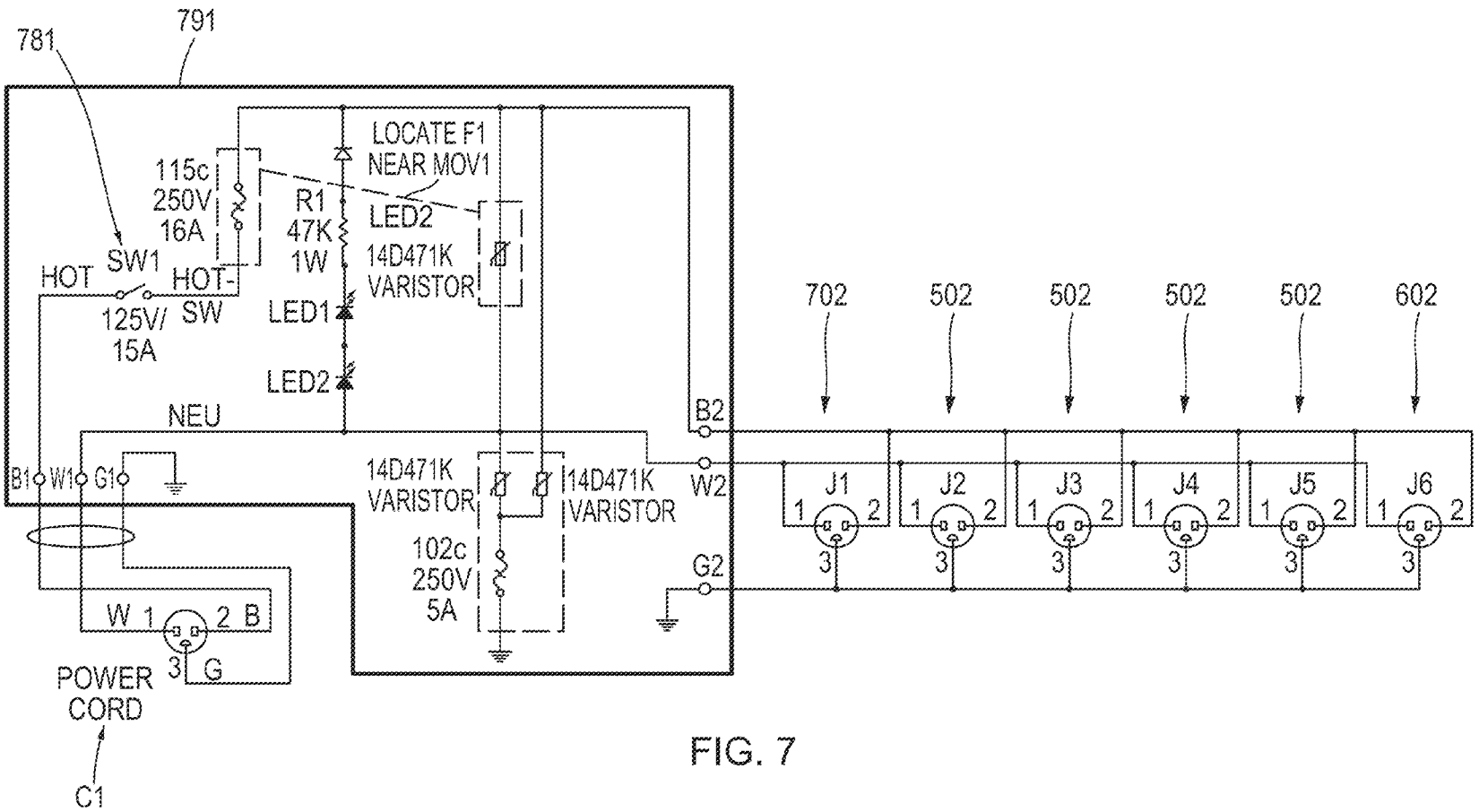
FIG. 7 is an electrical schematic diagram of the plug strip shown in FIG. 2A.

FIG. 7 is an electrical schematic diagram of plug strip 400, showing the functional relationship of the electrical components described above. These components include cord C1, printed circuit board 791, switch 781, and electrical portions 502, 602, and 702.

In some embodiments, a segment of a plug strip, e.g., a base segment, and intermediate segment, and/or an end segment can include different live, neutral, and/or ground connector embodiments. By way of example, while intermediate segment 500 includes live connector 541 including an integrally formed live track 542, live plug contact 543, and live track contact 544, in some embodiments, any of a live track, a live plug contact, and/or a live track contact can be integrally formed with, or formed separately from the other components of a live connector. Said another way, in some embodiments, a live connector can include a separately formed live track, a separately formed live plug contact, and/or a separately formed live track contact. Separately formed connector components can be operatively coupled, by way of example, by welding or the like and/or by tensioning (see, e.g., FIGS. 19, 20A, and 20B), and/or mechanically (see, e.g., FIGS. 22, 23A, and 23B). In some embodiments, a portion or all of the components of a connector can include or be connected by a flexible electrical wire (see, e.g., FIGS. 23, 24A, and 24B.

Figure 19:
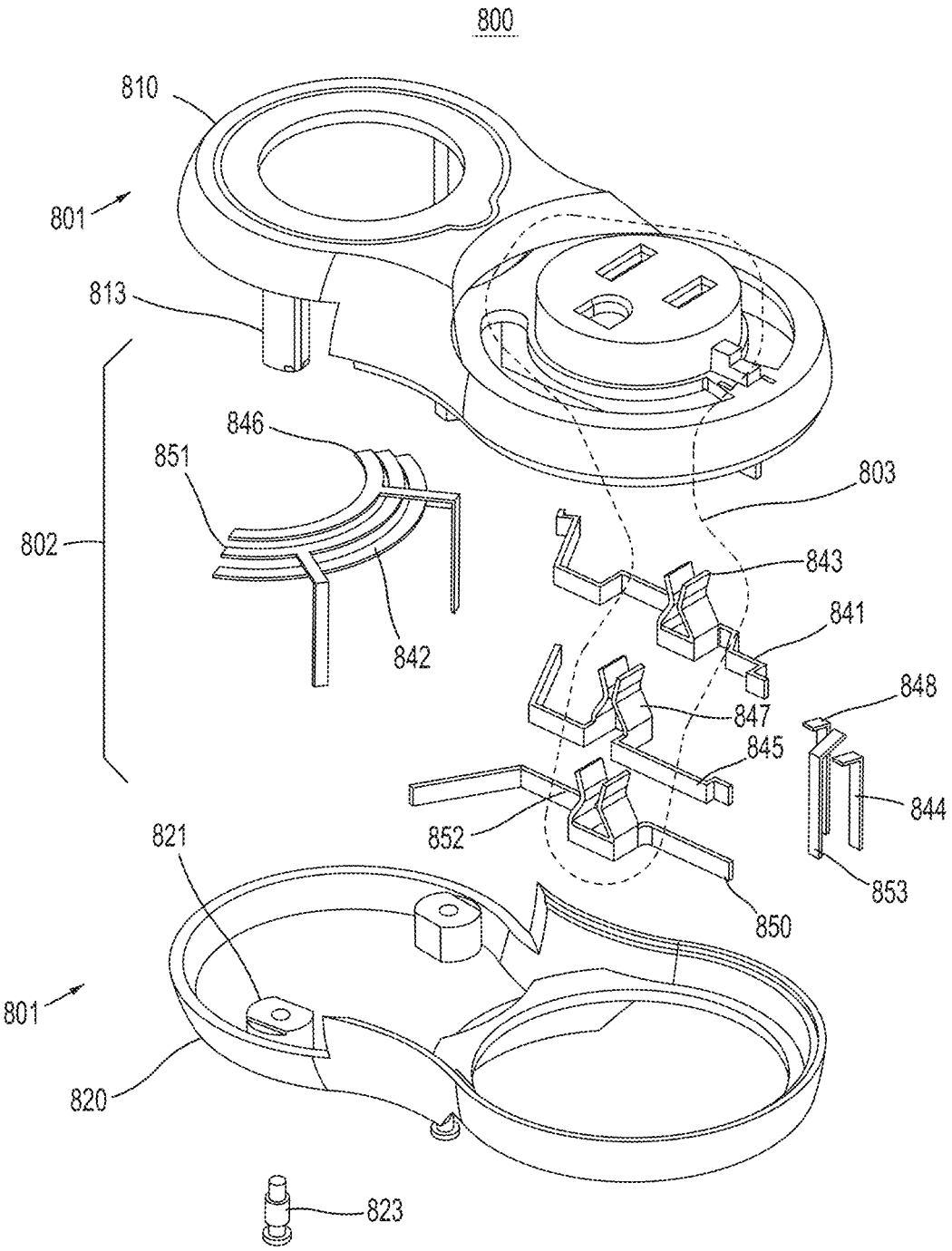
FIG. 19 is a fully exploded view of the intermediate segment according to another embodiment.
Figure 20A:
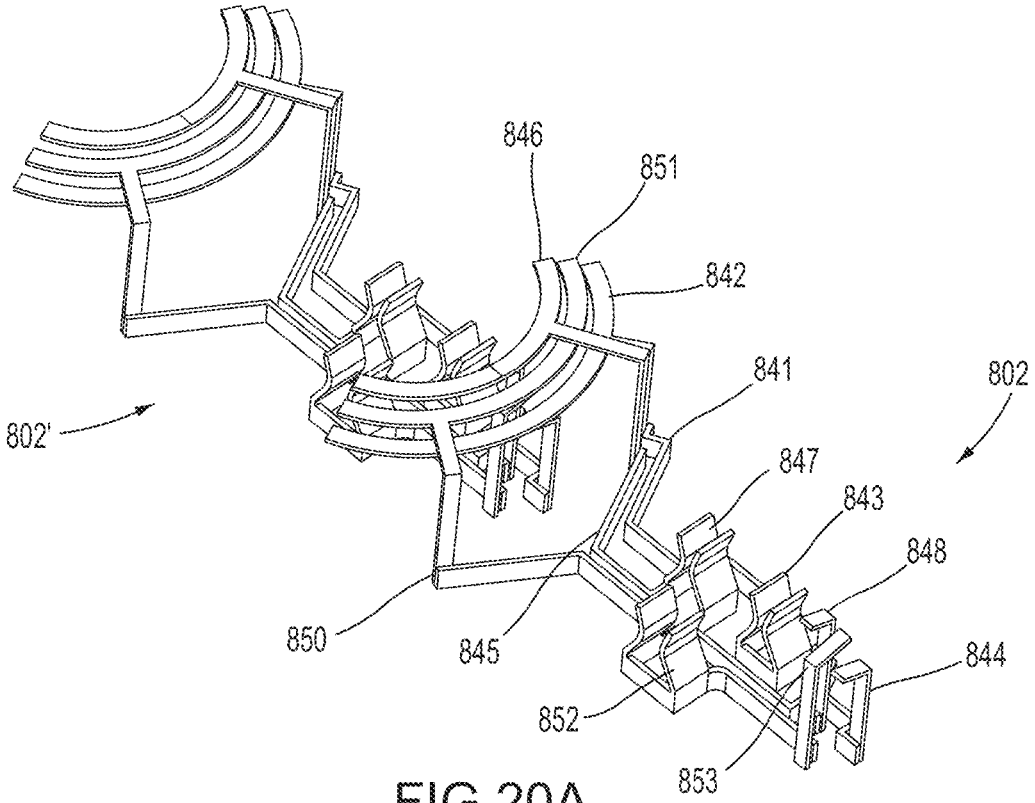
FIG. 20A is a perspective view of the electrical portion of the intermediate segment shown in FIG. 19 interconnected with the electrical portion of another segment of a plug strip, in a first configuration.
Figure 20B:
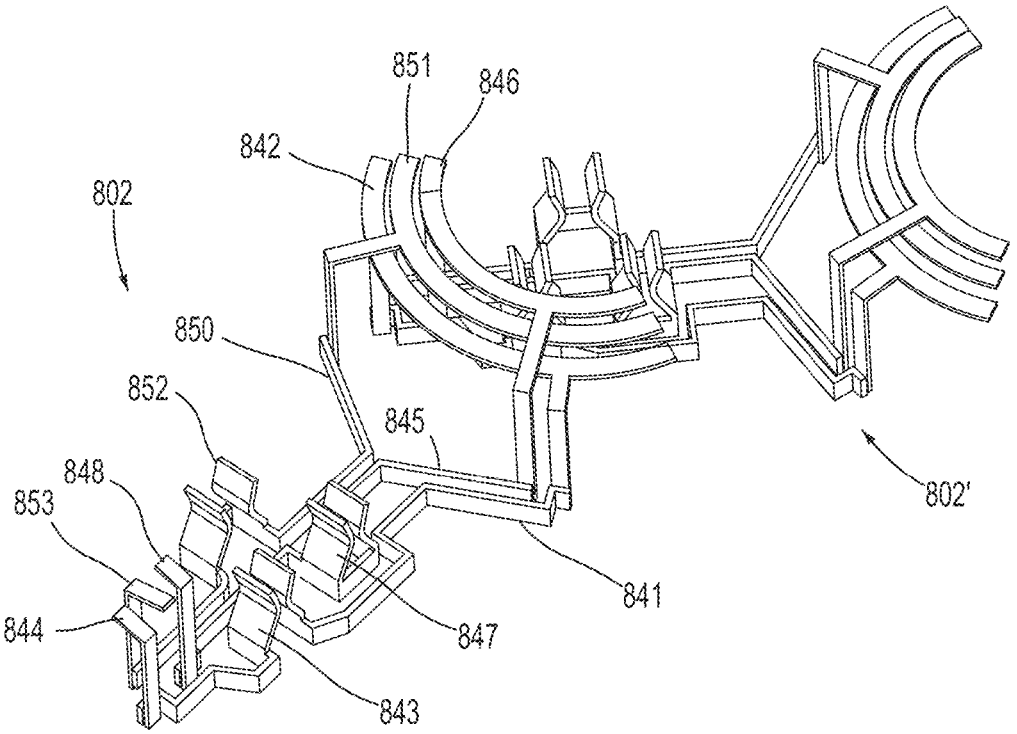
FIG. 20B is a perspective view of the electrical portion of the intermediate segment shown in FIG. 19 interconnected with the electrical portion of another segment of a plug strip, in a second configuration.

FIG. 19 is a fully exploded front perspective view of an intermediate segment 800, and FIGS. 20A and 20B show an electrical portion 802 of intermediate segment 800 and an electrical portion 802' of an intermediate portion 800'. Intermediate segments 800, 800' of a plug strip are substantially the same as intermediate segment 500. By way of example, intermediate segment 800 includes a mechanical portion 801 (similar to mechanical portion 501), an electrical portion 802 (similar to electrical portion 502), and an outlet portion 803 (similar to outlet portion 503). Intermediate segment 800 also includes a live connector 841, a neutral connector 845, and a ground connector 850. In contrast to intermediate segment 500, each connector 841, 845, 850 includes a track 842, 846, 851 separately formed from a plug contact 843, 847, 852 and a track contact 844, 848, 853. Each component of a connector live track 842, live plug contact 843, and live track contact 844 of live connector 841) can be operatively coupled to another component of the connector by welding or the like (e.g., brazing, soldering, etc) and/or tensioned to maintain contact. By way of example, live track 842 can be soldered to live plug contact 843, and live plug contact 843 can be soldered to live track contact 844.

Figure 21:
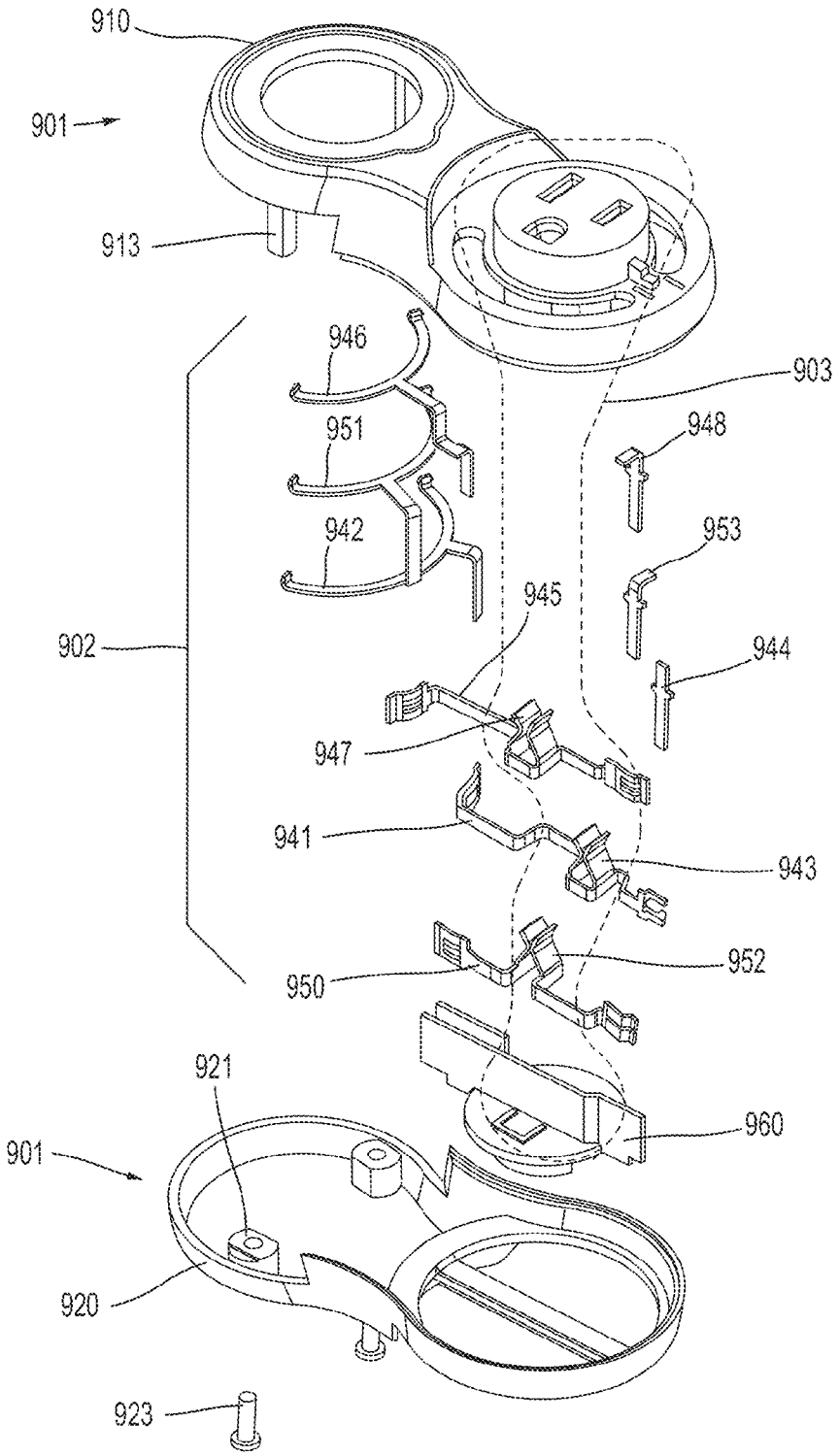
FIG. 21 is a fully exploded view of the intermediate segment according to another embodiment.
Figure 22A:
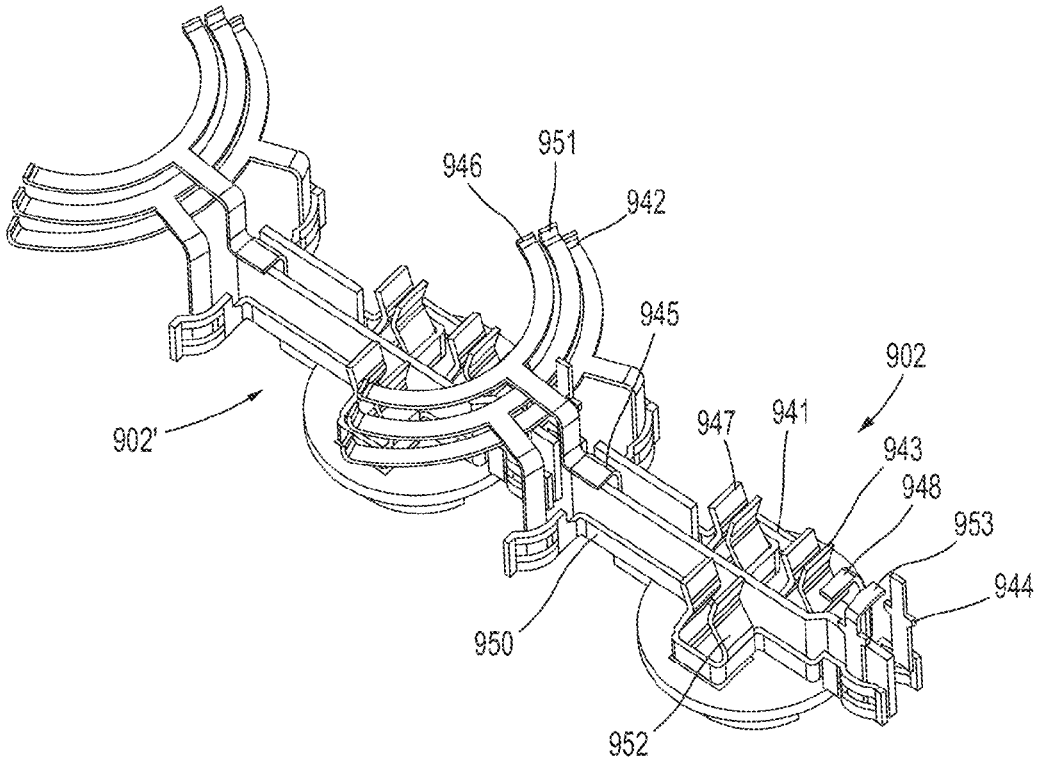
FIG. 22A is a perspective view of the electrical portion of the intermediate segment shown in FIG. 21 interconnected with the electrical portion of another segment of a plug strip, in a first configuration.
Figure 22B:
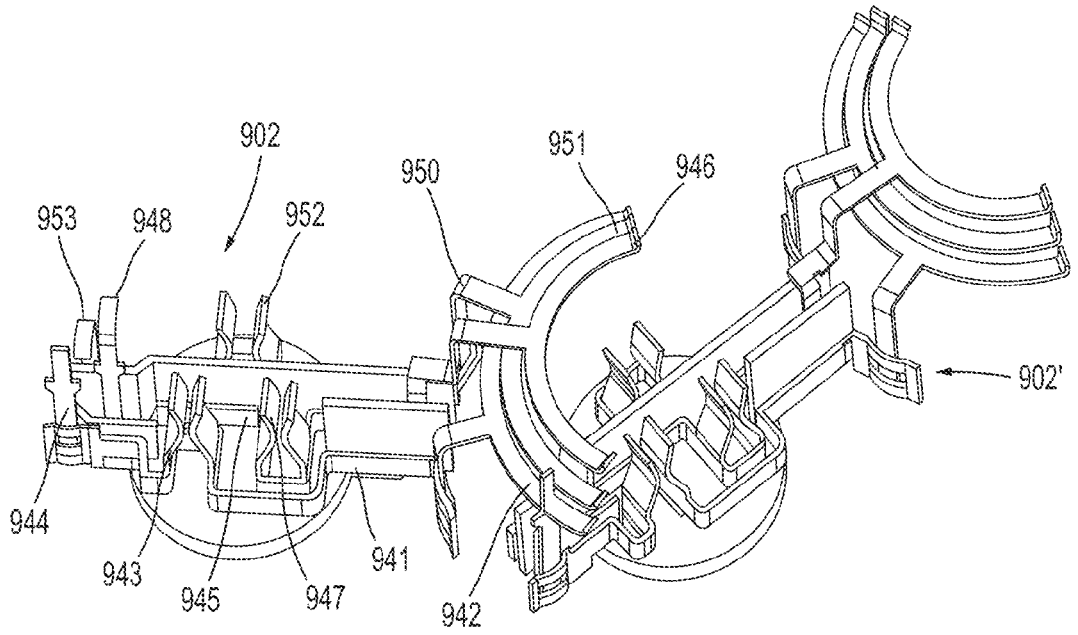
FIG. 22B is a perspective view of the electrical portion of the intermediate segment shown in FIG. 21 interconnected with the electrical portion of another segment of a plug strip, in a second configuration.

FIG. 21 is a fully exploded front perspective view of an intermediate segment 900, and FIGS. 22A and 22B show an electrical portion 902 of intermediate segment 900 and an electrical portion 902' of an intermediate portion 900. Intermediate segments 900, 900' of a plug strip are substantially the same as intermediate segments 500 and 800. By way of example, intermediate segment 900 includes a mechanical portion 901 (similar to mechanical portions 501 and 801), an electrical portion 902 (similar to electrical portions 502 and 802), and an outlet portion 903 (similar to outlet portions 503 and 803). Intermediate segment 900 also includes a live connector 941, a neutral connector 945, and a ground connector 950. In contrast to intermediate segment 500, each connector 941, 945, 950 includes a track 942, 946, 951 separately formed from a plug contact 943, 947, 952, and a track contact 944, 948, 953. Each component of a connector (e.g., live track 842, live plug contact 943, and live track contact 944 of live connector 941) can be operatively coupled mechanically to another component of the connector. By way of example, live track 942 can be disposed into a first mechanical fitting of live plug contact 943, and live track contact 944 can be disposed into a second mechanical fitting of live plug contact 943.

Figure 23:
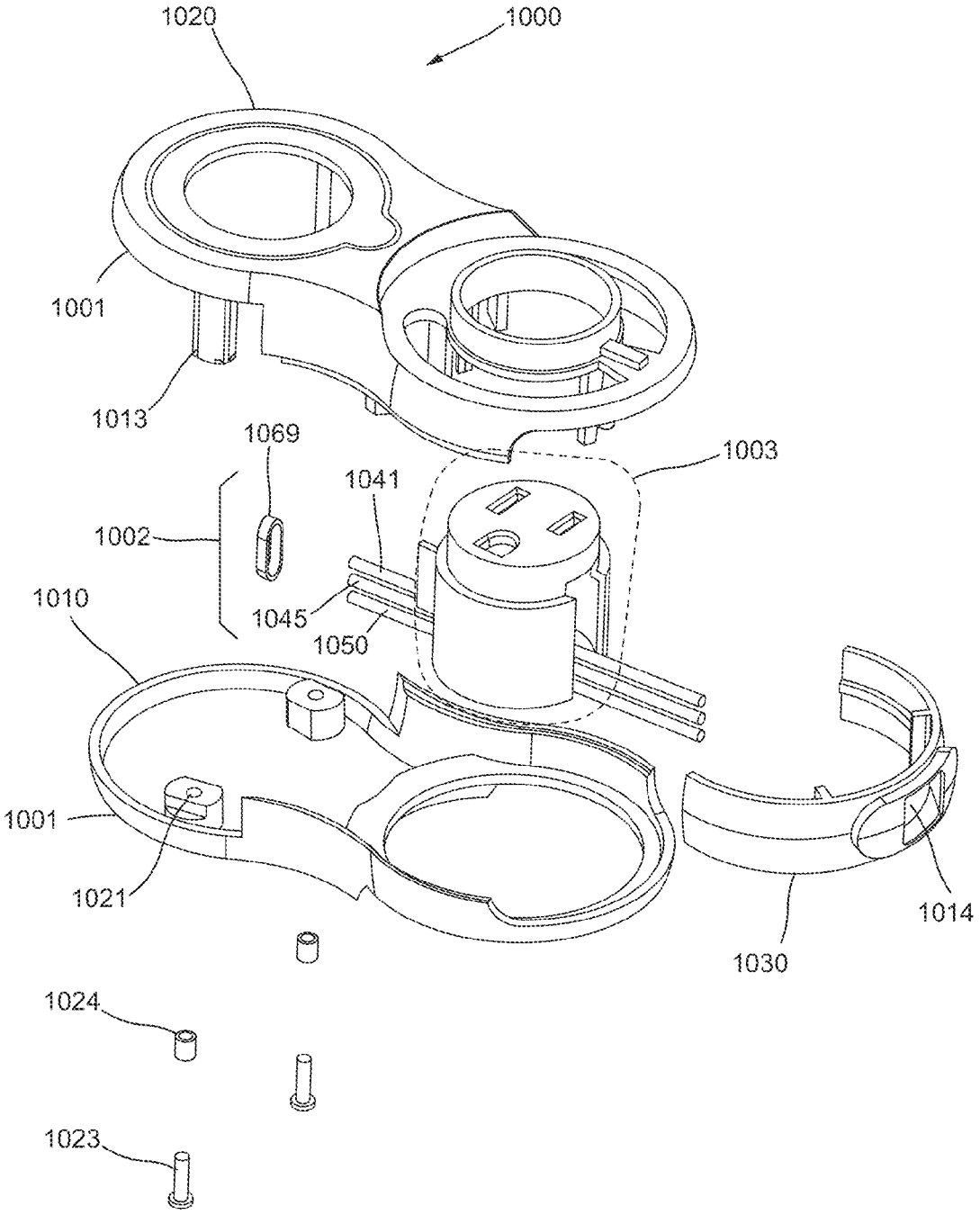
FIG. 23 is a fully exploded view of the intermediate segment according to another embodiment.
Figure 24A:
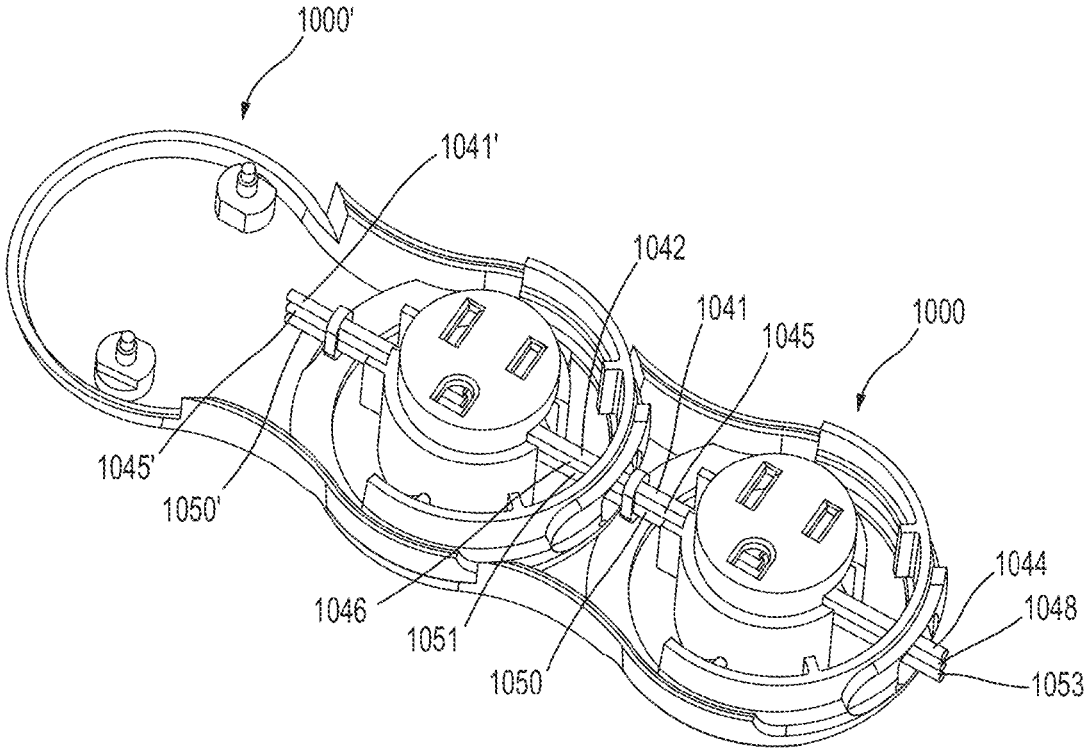
FIG. 24A is a top perspective view of a portion of the intermediate segment shown in FIG. 23 interconnected with a portion of another segment of a plug strip, in a first configuration.
Figure 24B:
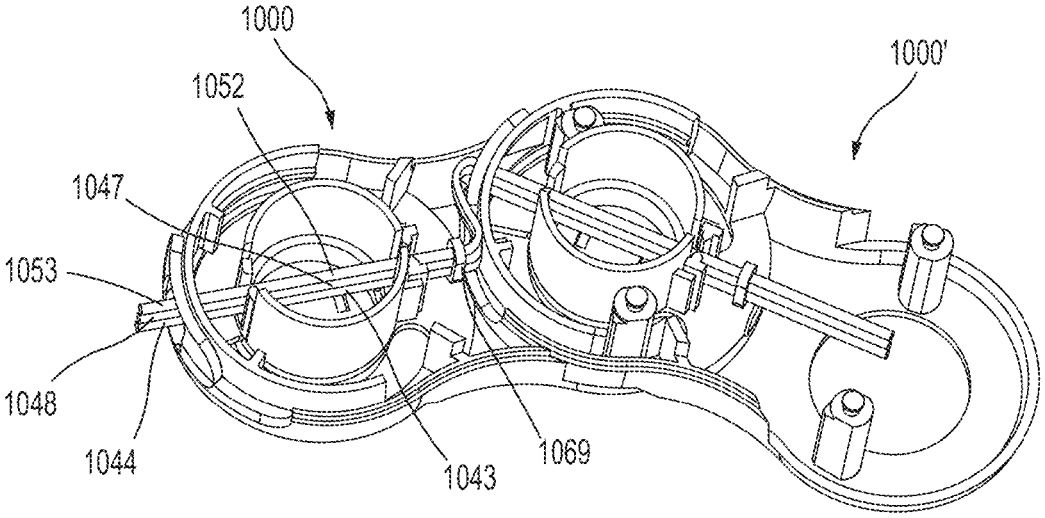
FIG. 24B is a bottom perspective view a portion of the intermediate segment shown in FIG. 23 interconnected with a portion of another segment of a plug strip, in the first configuration.

FIG. 23 is a fully exploded front perspective view of an intermediate segment 1000, and FIGS. 24A-24C show portions of intermediate segment 1000 and portions of an intermediate portion 1000'. Intermediate segments 1000, 1000' of a plug strip are substantially the same as intermediate segments 500, 800, and 900. By way of example, intermediate segment 1000 includes a mechanical portion 1001 (similar to mechanical portions 501, 801, and 901), an electrical portion 1002 (similar to electrical portions 502, 802, and 902), and an outlet portion 1003 (similar to outlet portions 503, 803, and 903). Intermediate segment 1000 also includes a live connector 1041, a neutral connector 1045, and a ground connector 1050. In contrast to intermediate segment 500, each connector 1041, 1045, 1050 can include an electrical wire and can be continuous with respective connectors 1041', 1045', 1050' in an adjacent intermediate segment 1000'. A connector can include a plug portion similar to a plug contact, a first connection portion similar to a track, and a second connection portion similar to a track contact. By way of example, intermediate segment 1000 includes live connector 1041 which includes first live connection portion 1042 which can function similar to live track 542, a plug portion 1043 which can function similar to live plug contact 543, and second live connection portion 1044 which can function similar to live track contact 544. In such embodiments. While each connector is depicted in FIGS. 23, 24A, and 24B as including separately formed section, e.g. each connector can include two electrical wires. In some embodiments, a connector can be continuous, e.g., a single electrical wire. In some embodiments, a connector, or a portion of a connector, can be continuous with a connector in an adjacent segment. Intermediate segment 1000 can include a fastener 1023, a spacer 1024, and a wire guide 1069.

Each of the components of the plug strips discussed herein can be monolithic or a combination of parts. By way of example, with reference to FIG. 4B, rotation post 513 and plug face 515 of top housing 510 can be a single piece. In other embodiments, rotation post 513 can be separate from top housing 510 and can be permanently or temporarily fixed to top housing 510. Similarly, and with reference to FIG. 7A, live connector 541 can be formed from a single piece of metal. In other embodiments, live plug contact 543 can be separate from live connector 541 and be permanently or temporarily fixed to live connector 541. Each of the components of the plug strips described herein can be cast (molded) into a final shape or configuration, may be manipulated (stamped and/or bent) into the final shape or configuration, and/or may be cast and manipulated into the final shape or configuration. Conducting components, such as live connector 541 can include any known conducting material, such as a metal or metal alloy, and non-conducting, insulating, and/or support members can include any know insulating material, such as a plastic, polymer, etc.

While various embodiments have been described above, it should be understood that they have been presented by way of example only, not limitation, and various changes in form and details may be made. While the plug strips are shown and described as having a certain number of segments, in some embodiments, more or fewer segment can be included. While the plug strips are shown and/or described as having certain configurations (i.e. straight, sinusoid, and circular), in some embodiments, the plug strips can have virtually any configuration based, at least, on the number of segments and/or characteristics of the segments. While the segments are shown and/or described as rotating about a single axis, in some embodiments, the segments can move relative to one another in more than one plane and/or axis, such as, for example, twisting about an axis perpendicular to a plug face, bending about an axis perpendicular to a plug face, translating along an axis, and/or combinations of such relative movements.

Apertures shown and described herein can be other shapes (uniform or non-uniform), a combination of shapes, and/or more than one aperture. By way of example, aperture 514 shown in FIG. 4A can be three apertures, i.e. one aperture for each plug track contact. While shown and/described as a 120V three prong plug, any of the plug strips described herein can be configured for other power sources, audio, video and/or data sources, or combinations of sources, such as, for example, universal serial bus, Fire Wire, international power standards, etc. In such embodiments, the plug strip and associated segments can have more or fewer signal paths, and more or fewer associated components in accordance with the signal requirements, such as, for example, connectors, tracks, insulation members, support members, etc. Furthermore, the components shapes and characteristics of the components can be modified based on the type of outlet/plug and the number of associated components.

Other aspects of the plug strips shown and described can be modified to affect the performance and/or characteristics of the plug strip. By way of example, in some embodiments, the range of relative motion can be defined by the size and/or shape of the rotation track, the size, shape, and/or number of rotation posts, and/or the type of plug/outlet. While switch 581 is shown and described as a button, in some embodiments, switch 581 can be a toggle, rocker, slider, etc. Similarly, indicator 584 can be any indicator, such as, for example, a uniform light source, non-uniform light source, can indicate on and/or off, etc. The plug strips can also include device protections, such as, for example, fuses, breakers, surge protection elements, etc.

Any portion of the apparatus and/or methods described herein may be combined in any combination, except mutually exclusive combinations. The embodiments described herein can include various combinations and/or sub-combinations of the functions, components and/or features of the different embodiments described.

The invention claimed is:

1. An apparatus, comprising:

a first housing segment comprising a first receptacle configured to receive at least an electrically conductive portion of a first device plug, the first housing segment comprising a first rotation track and a second rotation track, at least one of the first rotation track or the second rotation track configured to: allow the first housing segment to connect to a second housing segment, and define a range of rotational motion between the first housing segment and the second housing segment;

the second housing segment comprising a second receptacle configured to receive at least an electrically conductive portion of a second device plug, at least a portion of the second housing segment disposed in at least one of the first rotation track or the second rotation track and at least a portion of the second housing segment configured to move in at least the first rotation track or the second rotation track relative to the first housing segment in one or more planes and about one or more axes;

a signal port coupler configured to selectively conductively engage with a signal port; and an electrical connection assembly disposed in the first and second housing segments and configured to define a signal path between the first receptacle and the signal port coupler, and between the second receptacle and the signal port coupler.

2. The apparatus of claim 1, wherein the first housing segment comprises an arcuate surface configured to mate with the second housing segment.

3. The apparatus of claim 1, wherein at least one of the first rotation track and the second rotation track is arcuate.

4. The apparatus of claim 1, wherein the second housing segment comprises a first post disposed through the first rotation track of the first housing segment and a second post disposed through the second rotation track of the first housing segment.

5. The apparatus of claim 1, wherein the electrical connection assembly comprises a continuous flexible wire.

6. The apparatus of claim 1, further comprising:

a switch assembly configured to allow a user to selectively electrically couple a power source to the first and second receptacles.

7. An apparatus, comprising:

a base housing segment comprising a signal port coupler configured to selectively conductively engage with a signal port;

a first housing segment comprising a single receptacle configured to receive at least an electrically conductive portion of a first device plug, the first housing segment coupled to the base housing segment for pivotal movement relative to the base housing segment, the first housing segment comprising a first rotation track and a second rotation track;

a second housing segment comprising a single receptacle configured to receive at least an electrically conductive portion of a second device plug, the second housing segment coupled to the first housing segment, via at least one of the first rotation track or the second rotation track, for pivotal movement relative to the first housing segment in one or more planes and along one or more axes; and an electrical connection assembly disposed in the base, first, and second housing segments and configured to selectively conductively engage the receptacles of the first and second housing segments with a signal port.

8. The apparatus of claim 7, wherein the base housing segment comprises a switch assembly configured to allow a user to selectively electrically couple a power source to the receptacles in the first and second housing segments.

9. The apparatus of claim 7, wherein the electrical connection assembly comprises a flexible wire.

10. The apparatus of claim 9, wherein the flexible wire is continuous.

11. The apparatus of claim 7, further comprising:

a third housing segment comprising a single receptacle configured to receive at least an electrically conductive portion of a third device plug, the third housing segment coupled to the second housing segment for pivotal movement relative to the second housing segment, wherein the electrical connection assembly is disposed in the third housing segment and is configured to selectively conductively engage the receptacle of the third housing segment with a signal port.

12. The apparatus of claim 7, wherein the first housing segment comprises an aperture configured to receive at least a portion of the base housing segment.

13. An apparatus, comprising:

a first housing segment comprising a first receptacle configured to receive at least an electrically conductive portion of a first device plug, the first housing segment comprising a concave portion, a first rotation track and a second rotation track;

a second housing segment comprising a second receptacle configured to receive at least an electrically conductive portion of a second device plug, the second housing segment comprising a convex portion configured to mate with the concave portion of the first housing segment via at least one of the first rotation track or the second rotation track, to allow the second housing segment to pivot relative to the first housing segment in one or more planes and along one or more axes;

a signal port coupler configured to selectively conductively engage with a signal port; and an electrical connection assembly disposed in the first and second housing segments and configured to define a signal path between the first receptacle and the signal port coupler, and between the second receptacle and the signal port coupler.

14. The apparatus of claim 13, wherein the second housing segment comprises a concave surface, the apparatus further comprising:

a third housing segment comprising a third receptacle configured to receive at least an electrically conductive portion of a third device plug, the third housing segment comprising a convex portion configured to mate with the concave portion of the second housing segment to allow the third housing segment to pivot relative to the second housing segment, wherein the electrical connection assembly is disposed in the third housing segment and is configured to define a signal path between the third receptacle and the signal port coupler.

15. The apparatus of claim 13, wherein the electrical connection assembly comprises a continuous flexible wire.

16. The apparatus of claim 13, wherein the electrical connection assembly comprises a first wire configured to define a first signal path between the first receptacle and the signal port coupler, and a second wire configured to define a second signal path between the second receptacle and the first wire.

17. The apparatus of claim 13, wherein the signal path is configured to conduct at least one of power, data, audio, video, universal serial bus, Fire Wire and international power standards.

18. The apparatus of claim 13, wherein at least one of the first receptacle and the second receptacle comprises at least one of a 3 prong plug, data, audio, video, universal serial bus, Fire Wire and international power standard receptacle.

19. The apparatus of claim 13, further comprising:

a switch assembly configured to allow a user to selectively electrically couple a power source to the first and second receptacles.

20. The apparatus of claim 13, further comprising:

an indicator configured to visually indicate to a user when a circuit is conductively engaged.

21. The apparatus of claim 13, further comprising:

a printed circuit board configured to provide surge protection for the apparatus.

* * * * *